US010490338B2

(12) United States Patent
Sano et al.

(10) Patent No.: US 10,490,338 B2
(45) **Date of Patent: *Nov. 26, 2019**

(54) INDUCTOR COMPONENT AND METHOD OF MANUFACTURING SAME

(71) Applicant: Murata Manufacturing Co., Ltd., Kyoto (JP)

(72) Inventors: Rikiya Sano, Nagaokakyo (JP); Yoshiyuki Oota, Nagaokakyo (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/228,737

(22) Filed: Dec. 20, 2018

(65) Prior Publication Data

US 2019/0148058 A1 May 16, 2019

Related U.S. Application Data

(63) Continuation of application No. 15/684,539, filed on Aug. 23, 2017, now Pat. No. 10,229,781.

(30) Foreign Application Priority Data

Sep. 23, 2016 (JP) ..... 2016-186172

(51) Int. Cl.
*H01F 27/29* (2006.01)
*H01F 27/34* (2006.01)
(Continued)

(52) U.S. Cl.
CPC ..... *H01F 27/341* (2013.01); *H01F 17/0013* (2013.01); *H01F 27/2804* (2013.01); *H01F 27/29* (2013.01); *H01F 27/292* (2013.01); *H01F 27/323* (2013.01); *H01F 41/043* (2013.01); *H01F 41/122* (2013.01); *H01F 2027/2809* (2013.01)

(58) Field of Classification Search
CPC ..... H01F 5/00; H01F 27/00–36
USPC ..... 336/65, 83, 200, 206–208, 232
See application file for complete search history.

(56) References Cited

U.S. PATENT DOCUMENTS 7,701,319 B2 * 4/2010 Kitamura ..... H01F 17/0013 336/200
2004/0164835 A1 8/2004 Shoji
(Continued)

FOREIGN PATENT DOCUMENTS

CN 1258777 6/2006
JP 2014-107513 A 6/2014

*Primary Examiner* — Tuyen T Nguyen
(74) *Attorney, Agent, or Firm* — Studebaker & Brackett PC

(57) ABSTRACT

An inductor component having an element body includes two end surfaces opposite to each other and a bottom surface connected between the two end surfaces. A coil is provided in the element body and wound helically. Two external electrodes are provided in the element body and electrically connected to the coil. One of the external electrodes is formed over one of the end surfaces and the bottom surface while the other external electrode is formed over the other of the end surfaces and the bottom surface. The coil is formed such that an axial direction thereof is along the two end surfaces and the bottom surface. The coil includes a coil wiring wound along a plane orthogonal to the axial direction, and the aspect ratio of the coil wiring is 1.0 or more and less than 8.0.

20 Claims, 22 Drawing Sheets

(51) Int. Cl.

| | |
|---|---|
| ***H01F 27/28*** | (2006.01) |
| ***H01F 27/32*** | (2006.01) |
| ***H01F 41/04*** | (2006.01) |
| ***H01F 41/12*** | (2006.01) |
| ***H01F 17/00*** | (2006.01) |

(56) References Cited

U.S. PATENT DOCUMENTS

| | | | |
|---|---|---|---|
| 2015/0255208 | A1 | 9/2015 | Kim et al. |
| 2016/0086719 | A1 | 3/2016 | Jeong |

* cited by examiner

INDUCTOR COMPONENT AND METHOD OF MANUFACTURING SAME

CROSS REFERENCE TO RELATED APPLICATIONS

This application is a Continuation of U.S. patent application Ser. No. 15/684,539 filed Aug. 23, 2017, which claims benefit of priority to Japanese Patent Application 2016-186172 filed Sep. 23, 2016, the entire content of which is incorporated herein by reference.

TECHNICAL FIELD

The present disclosure relates to an inductor component and a method of manufacturing the same.

BACKGROUND

A conventional inductor component is described in Japanese Laid-Open Patent Publication No. 2014-107513. This inductor component has a component main body including a mounting surface and an external electrode formed on the mounting surface. The component main body has an element body made up of a plurality of insulator layers and a coil provided in the element body and wound into a helical shape.

The coil is made up of coil wirings formed on the insulator layers and via wirings penetrating the insulator layers and electrically connecting a plurality of the coil wirings in series. The axis of the coil is substantially parallel to the mounting surface. The via wirings are formed only on the side farthest from the mounting surface.

As a result, the distance between the external electrode and the via wirings can be made larger to reduce a stray capacitance between the external electrode and a coil conductor so as to achieve an improvement in Q characteristics.

SUMMARY

Problem to be Solved by the Disclosure

However, the conventional inductor component is still insufficiently improved in the Q value and has room for improvement particularly in improvement in the Q value at higher frequencies.

Therefore, a problem to be solved by the present disclosure is to provide an inductor component capable of improving the Q value.

Solutions to the Problems

To solve the problem, an aspect of the present disclosure provides an inductor component comprising:

an element body including two end surfaces opposite to each other and a bottom surface connected between the two end surfaces;

a coil provided in the element body and wound helically; and two external electrodes provided in/on the element body and electrically connected to the coil, wherein one of the external electrodes is formed over one of the end surfaces and the bottom surface while the other external electrode is formed over the other of the end surfaces and the bottom surface, wherein the coil is formed such that an axial direction thereof is along the two end surfaces and the bottom surface, wherein the coil includes a coil wiring wound along a plane orthogonal to the axial direction, and wherein the aspect ratio of the coil wiring is 1.0 or more and less than 8.0.

The aspect ratio of the coil wiring is (the thickness of the coil wiring in the axial direction of the coil)/(the wiring width of the coil wiring). The axial direction of the coil refers to the direction parallel to the central axis of the helix formed by winding the coil. The wiring width of the coil wiring refers to the width in the direction orthogonal to the axial direction of the coil in a cross section (transverse cross section) orthogonal to the extending direction of the coil wiring.

According to the inductor component, the Q value can be increased.

In an embodiment of the inductor component, the aspect ratio of the coil wiring is 1.5 or more and less than 6.0.

According to the embodiment, the Q value can further be increased.

In an embodiment of the inductor component, the coil wiring is made up of a plurality of coil conductor layers laminated in surface contact with each other.

According to the embodiment, the coil wiring with a high aspect ratio and a high rectangular degree can be formed.

In an embodiment of the inductor component, the multiple coil conductor layers constituting the coil wiring are equal to each other in wiring length and are in surface contact with each other over the wiring length.

According to the embodiment, the aspect ratio and the rectangular degree can be made higher over the entire coil wiring. The wiring length refers to the length along the extending shape of the coil conductor layer.

In an embodiment of the inductor component, the wiring width of the coil wiring is 60 μm or less.

According to the embodiment, the inner diameter of the coil can be ensured, and the Q value can be increased.

In an embodiment of the inductor component, the coil wiring varies in wiring width along the axial direction, the coil wiring has an inner surface partially projecting to the inside of the coil wiring, and a ratio (e/c) of a projection amount e of the inner surface to a maximum wiring width c of the coil wiring is 20% or less.

In an embodiment of the inductor component, the ratio (e/c) is 5% or less.

In an embodiment of the inductor component, the coil wiring varies in wiring width along the axial direction, and a ratio (a/c) of a difference (a) between a maximum wiring width (c) and a minimum wiring width of the coil wiring to the maximum width (c) is 40% or less.

According to the embodiment, a resistance loss at high frequencies can be suppressed to improve the Q value.

In an embodiment of the inductor component, the aspect ratio of the coil conductor layer is 2.0 or less.

According to the embodiment, the coil wiring with a high aspect ratio can stably be formed.

In an embodiment of the inductor component, no intervening layer exists between the coil conductor layers in surface contact and between the coil conductor layers and the element body.

According to the embodiment, the adhesion strength can be prevented from deteriorating between the coil conductor layers and between the coil conductor layers and the element body.

In an embodiment of the inductor component, an intervening layer exists in at least a portion between the coil conductor layers in surface contact and between the coil conductor layers and the element body.

According to the embodiment, a method using the intervening layer can be permitted for forming the coil wiring.

In an embodiment of the inductor component, a transverse cross section of the coil wiring has a T shape, an I shape, or a stacked shape of T.

According to the embodiment, the coil wiring with a high aspect ratio can stably be formed.

In an embodiment of the inductor component, the plurality of coil conductor layers constituting the coil wiring includes a first coil conductor layer and a second coil conductor layer having the same width in a coil radial direction, and a ratio (d/c) of a deviation amount d between the center of the wiring width of the first coil conductor layer and the center of the wiring width of the second coil conductor layer to the wiring width c of the first coil conductor layer and the second coil conductor layer is 20% or less.

According to the embodiment, a resistance loss at high frequencies can be suppressed to improve the Q value.

In an embodiment of the inductor component, the length of the coil in the axial direction is equal to or greater than 50% of the width of the element body in the axial direction.

According to the embodiment, the coil length can be increased and the Q value can be improved. The coil length refers to the length of the coil in the axial direction.

In an embodiment of a method of manufacturing an inductor component, a portion of the plurality of coil conductor layers is formed by a semi-additive method.

In an embodiment of a method of manufacturing an inductor component, the plurality of coil conductor layers is all formed by a semi-additive method.

In an embodiment of a method of manufacturing an inductor component, a portion of the plurality of coil conductor layers is formed by plating growth.

In an embodiment of a method of manufacturing an inductor component, a portion of the plurality of coil conductor layers is further formed by plating growth.

In an embodiment of a method of manufacturing an inductor component, the plurality of coil conductor layers is all further formed by plating growth.

An embodiment of a method of manufacturing an inductor component comprises the steps of:

forming a first groove in a first insulating layer constituting the element body;

applying a photosensitive conductive paste into the first groove to form a first coil conductor layer in the first groove by a photolithographic method;

forming a second insulating layer constituting the element body on the first insulating layer and forming a second groove in the second insulating layer; and applying a photosensitive conductive paste into the second groove to form a second coil conductor layer coming into surface contact with the first coil conductor layer in the second groove by a photolithographic method.

The embodiment is more advantageous for forming the high-aspect-ratio coil wiring and lowering the electric resistance of the coil wiring.

Effect of the Disclosure

According to the inductor component of the present disclosure, the Q value can be increased.

DETAILED DESCRIPTION

An inductor component considered as a form of the present disclosure will now be described in detail with shown embodiments. It is noted that some of the drawings are schematic and may not reflect actual dimensions and ratios.

First Embodiment

Figure 1:
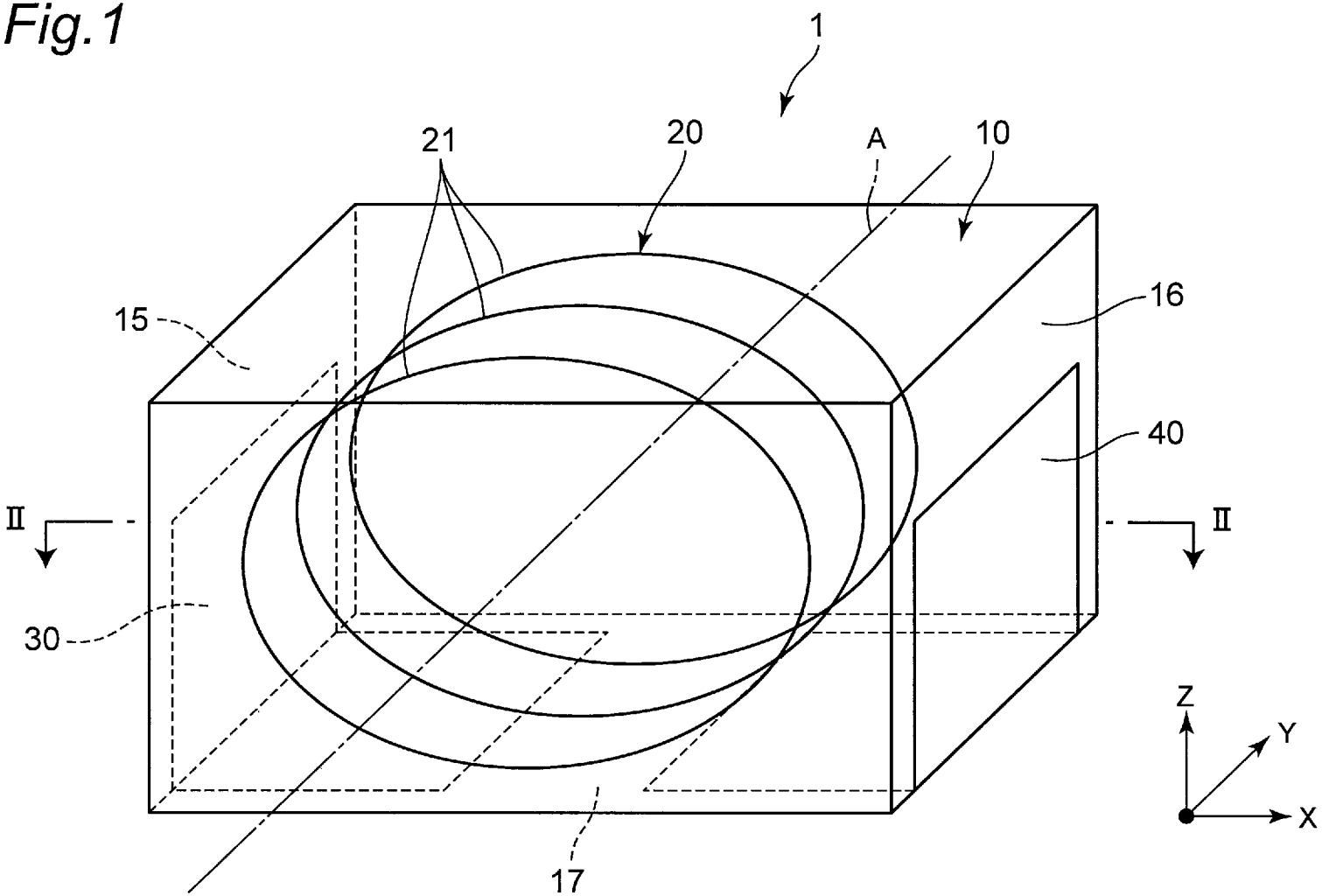
FIG. 1 is a schematic perspective view of a first embodiment of an inductor component.
Figure 2:
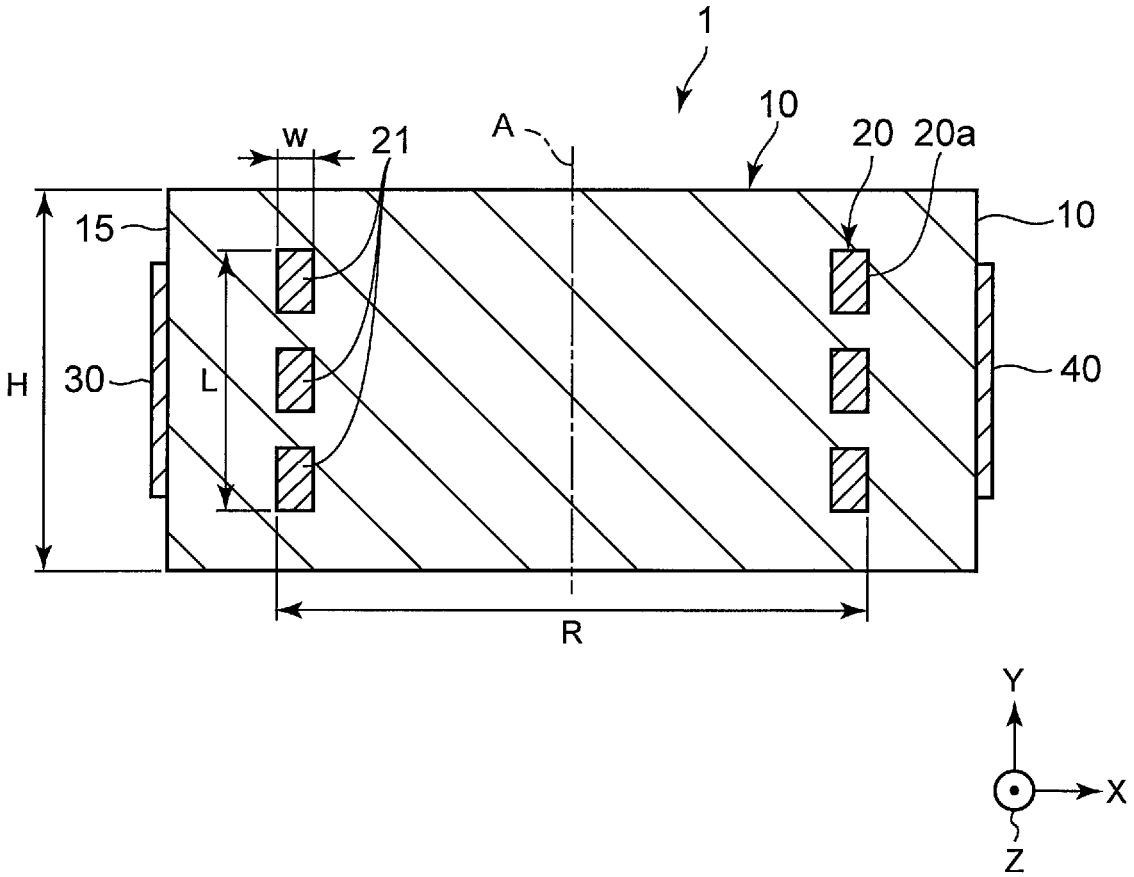
FIG. 2 is a schematic cross-sectional view of the inductor component.

FIG. 1 is a schematic perspective view of a first embodiment of an inductor component. FIG. 2 is a schematic cross-sectional view of the inductor component. As shown in FIGS. 1 and 2, an inductor component 1 has an element body 10, a helical coil 20 provided inside the element body 10, and a first external electrode 30 and a second external electrode 40 provided on the element body 10 and electrically connected to the coil 20. In FIG. 1, the coil 20 is schematically represented by three overlapping ellipses without showing a detailed structure. The cross section of FIG. 2 corresponds to a cross section II-II of the inductor component 1 taken along a plane including an axis A and parallel to the XY plane.

The inductor component 1 is electrically connected via the first and second external electrodes 30, 40 to a wiring of a circuit board not shown. The inductor component 1 is used as an impedance matching coil (matching coil) of a high-frequency circuit, for example, and is used for an electronic device such as a personal computer, a DVD player, a digital camera, a TV, a portable telephone, and automotive electronics, as well as medical/industrial equipment.

The element body 10 is formed into a substantially rectangular parallelepiped shape. The surface of the element body 10 has a first end surface 15, a second end surface 16 opposite to the first end surface 15, and a bottom surface 17 connected between the first end surface 15 and the second end surface 16. As shown in the figure, an X direction is a direction orthogonal to the first end surface 15 and the second end surface 16; a Y direction is a direction parallel to the first and second end surfaces 15, 16 and the bottom surface 17; and a Z direction is a direction orthogonal to the X direction and the Y direction and is a direction orthogonal to the bottom surface 17.

The element body 10 is formed by laminating a plurality of insulating layers. The insulating layers are made of, for example, a glass material mainly composed of borosilicate glass, a ceramic material mainly composed of ferrite, a resin material mainly composed of polyimide, etc. The lamination direction of the insulating layers is a direction (Y direction) parallel to the first and second end surfaces 15, 16 and the bottom surface 17 of the element body 10. Therefore, the insulating layers have a layered shape spreading in the XZ plane. In the inductor component 1, the plurality of the insulating layers may be in a state in which the interfaces of the insulating layer are not visible due to sintering.

The first external electrode 30 and the second external electrode 40 are made of a conductive material such as Ag or Cu, for example. The first external electrode 30 has an L shape provided over the first end surface 15 and the bottom surface 17. The second external electrode 40 has an L shape provided over the second end surface 16 and the bottom surface 17.

The coil 20 is made of a conductive material such as Ag or Cu, for example. Although not shown, one end of the coil 20 is connected to the first external electrode 30 and the other end of the coil 20 is connected to the second external electrode 40 through lead-out wirings etc. The coil 20 is wound into a helical shape around the axis A and is disposed such that an axial direction thereof (hereinafter sometimes simply referred to as "the axial direction") is along the first and second end surfaces 15, 16 and the bottom surface 17. In other words, an outer circumferential surface 20*a* of the coil 20 faces the first and second end surfaces 15, 16 and the bottom surface 17 of the element body 10. The direction of the magnetic flux generated by the coil 20 is the direction along the axis A on the inner and outer circumferences of the coil 20 and is therefore not orthogonal to the first and second end surfaces 15, 16 and the bottom surface 17. As a result, the first and second external electrodes 30, 40 do not interfere with the magnetic flux of the coil 20 and a loss due to the eddy current loss can be reduced, so that the Q value of the inductor component 1 can be improved. The axial direction of the coil 20 coincides with the Y direction.

"The axial direction of the coil 20 is along the first and second end surfaces 15, 16 and the bottom surface 17" includes not only the case that the axial direction of the coil 20 is completely parallel to the first and second end surfaces 15, 16 and the bottom surface 17 but also the case that the axial direction of the coil 20 is slightly inclined with respect to at least one of the first and second end surfaces 15, 16 and the bottom surface 17, and means that the direction is substantially parallel.

The coil 20 includes a plurality of coil wirings 21 laminated along the axial direction. The coil wirings 21 are formed by being wound on the principal surfaces (XZ planes) of the insulating layers orthogonal to the axial direction. The coil wirings 21 adjacent to each other in the lamination direction are electrically connected in series through via wirings penetrating the insulating layers in the thickness direction (Y direction). In this way, the plurality of the coil wirings 21 constitute a helix while being electrically connected in series to each other. The coil 20 may be made up of a single layer of the coil wiring 21 and may have a configuration in which, for example, both ends of the single-layer coil wiring 21 wound less than one turn on the principal surface of the insulating layer are respectively connected through lead-out wirings etc. to the first external electrode 30 and the second external electrode 40.

A length L of the coil 20 in the axial direction is preferably equal to or greater than 50% of a width H of the element body 10 in the axial direction (Y direction). The length L of the coil 20 in the axial direction is preferably equal to or less than 80% of the width H of the element body 10 in the axial direction. The length L of the coil 20 in the axial direction is determined by the coil wirings 21 at both axial ends of the coil 20, and connecting portions to the first external electrode 30 and the second external electrode 40 such as the lead-out wirings are not considered.

Figure 3:
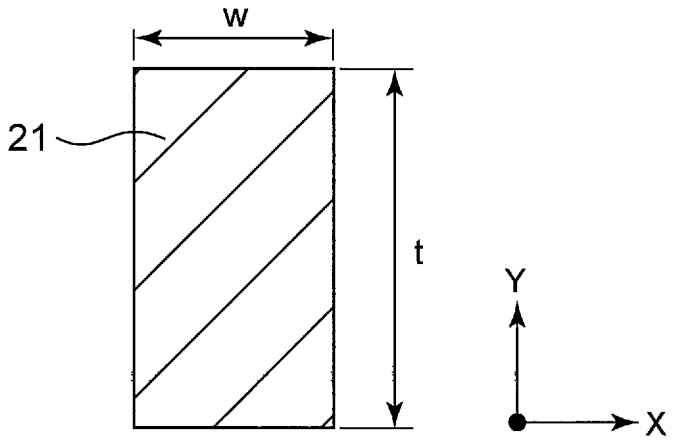
FIG. 3 is an enlarged view of a cross section of a coil wiring shown in FIG. 2.

FIG. 3 is an enlarged view of a cross section of the coil wiring 21 shown in FIG. 2. In the cross sections of FIGS. 2 and 3, the coil wirings 21 extend in the Z direction and, therefore, the cross sections of the coil wirings 21 shown in FIGS. 2 and 3 are transverse cross sections of the coil wirings 21. As shown in FIG. 3, the aspect ratio of the coil wiring 21 is 1.0 or more and less than 8.0, preferably 1.5 or more and less than 6.0. The aspect ratio is (a thickness t of the coil wiring 21 in the axial direction (Y direction))/(a wiring width w of the coil wiring 21). In FIG. 3, the wiring width w is a width in the X direction orthogonal to the axial direction (Y direction). Although the cross section of the coil wiring 21 is rectangular in FIG. 3, the actual coil wiring 21 may not be rectangular. Even in this case, the aspect ratio of the coil wiring 21 can be calculated from the cross-sectional area of the coil wiring 21 and the maximum thickness of the coil wiring 21 in the axial direction. Specifically, the thickness t may be the maximum thickness of the coil wiring 21 in the axial direction, and the wiring width w may be a value obtained by dividing the cross-sectional area of the coil wiring 21 by the maximum thickness of the coil wiring 21. As a result, even if unevenness is formed on the inner surface and the outer surface of the coil wiring 21, the aspect ratio can easily be obtained. As described above, the cross-sectional shape of the coil wiring 21 is not limited to a rectangular shape and includes an elliptical shape, a polygonal shape, shapes acquired by giving unevenness to these shapes, etc. Additionally, as described above, the coil wiring 21 is a wiring wound on the principal surface of the insulating layer and is distinguished from the via wiring penetrating the insulating layer in the thickness direction. Therefore, the thickness and the wiring width of the via wiring are not taken into account in calculation of the aspect ratio of the coil wiring 21. It is noted that the inner surface of the coil wiring 21 refers to a surface facing the axis A side of the coil wiring 21 (a surface on the inner side of FIG. 2) and that the outer surface of the coil wiring 21 refers to a surface opposite to the inner surface of the coil wiring 21 (the outer circumferential surface 20*a* of FIG. 2).

According to the inductor component 1, the first and second external electrodes 30, 40 have an L shape exposed only on the end surfaces 15, 16 and the bottom surface 17. Therefore, the first and second external electrodes 30, 40 can be miniaturized while ensuring a bonding force to a mounting board by forming a solder fillet on the sides of the end surfaces 15, 16 at the time of mounting. Additionally, the blocking of the magnetic flux of the coil 20 can be reduced to improve the Q value.

The coil 20 is disposed such that the axial direction is along the two end surfaces 15, 16 and the bottom surface 17 of the elementary body 10. Therefore, the coil 20 is laterally wound. Even if the thickness t of the coil wiring 21 in the axial direction is increased, the intervals from the coil wiring 21 to the end surfaces 15, 16 and the bottom surface 17 are not changed, so that the aspect ratio of the coil wiring 21 can be made higher without bringing the coil 20 closer to the end surface 15, 16 and the bottom surface 17 of the element body 10. As a result, even when the aspect ratio of the coil wiring 21 is made higher, an increase in the stray capacitance between the coil wiring 21 and the first and second external electrodes 30, 40 can be avoided. Additionally, since a large portion of the magnetic flux generated by the coil 20 is parallel to the bottom surface 17, the blocking of the magnetic flux by metal in the mounting board can be reduced when the bottom surface 17 of the element body 10 is mounted on the mounting board, and the Q value can be improved.

The aspect ratio of the coil wiring 21 is 1.0 or more and less than 8.0. Since the aspect ratio is 1.0 or more, the effect of reducing an electric resistance at high frequencies can be acquired due to an increase in the area of the inner surface of the coil wiring 21 (corresponding to a skin area of the coil 20 for a high frequency signal) and, since the aspect ratio is less than 8.0, the effect of increasing an electric resistance due to a decrease in the cross-sectional area of the coil wiring 21 can be suppressed. This leads to a high acquisition efficiency of the Q value with respect to the L value, so that the Q value can consequently be improved. This will hereinafter be described in detail.

Figure 4:
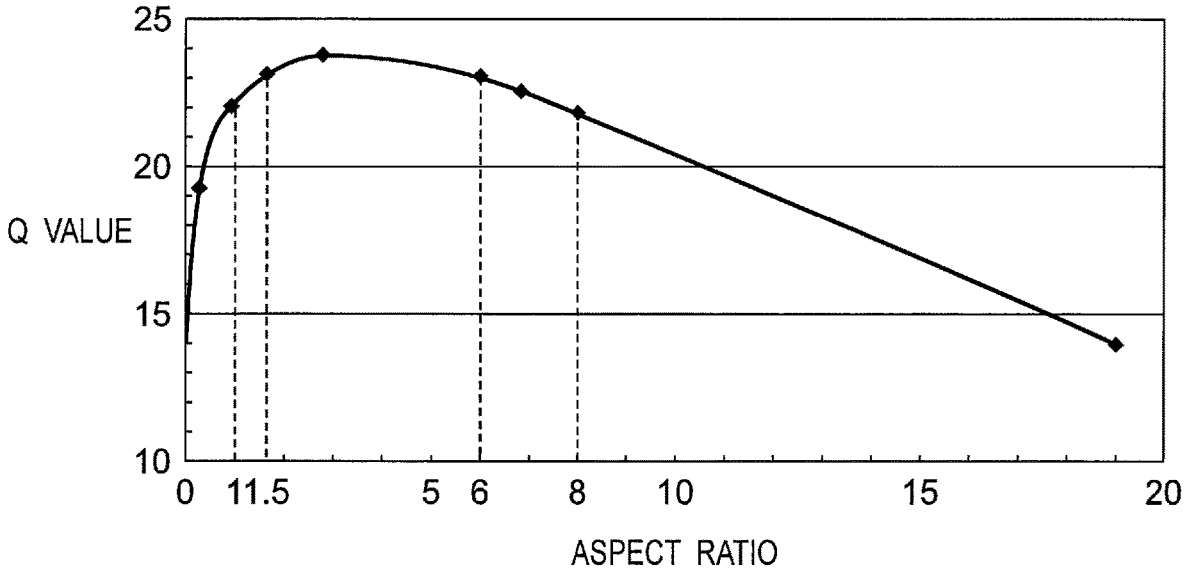
FIG. 4 is a graph of a relationship between the aspect ratio of the coil wiring and the Q value of the inductor component.

FIG. 4 shows a relationship between the aspect ratio of the coil wiring and the Q value of the inductor component. The horizontal axis of the graph of FIG. 4 indicates the aspect ratio of the coil wiring, and the vertical axis indicates the Q value of the inductor component. The graph of FIG. 4 shows the Q value of the inductor component acquired when the aspect ratio of the coil wiring is changed in a simulation. In the simulation, the aspect ratio is changed with the L value of the inductor component and the outer diameter of the coil kept constant. In other words, although an infinite number of combinations exists between the thicknesses and the wiring width of the coil wiring having the same aspect ratio, the thickness (the length of the coil in the axial direction) and the wiring width (the coil inner diameter) of the coil wiring are set among them such that the predetermined L value and outer diameter are achieved. The graph of FIG. 4 shows a state of the inductor component having a chip size of 0402 size (the mounting surface is 0.4 mm×0.2 mm) and the L value of 1.5 nH when the input signal to the inductor component has the signal frequency of 1 GHz. The outer diameter of the coil is a value obtained from the area surrounded by the outer circumferential surface 20*a* when the coil is viewed in the axial direction, and is twice as large as the square root (theoretical radius) of the value acquired by dividing the area by the circular constant.

As shown in FIG. 4, the Q value of the inductor component has a convex curve shape with respect to the aspect ratio, and it can be seen that a high Q value can be acquired when the aspect ratio is 1.0 or more and less than 8.0. It can also be seen that a higher Q value can be acquired when the aspect ratio is 1.5 or more and less than 6.0.

As a result of extensive studies, the present inventors derived the relationship between the aspect ratio and the Q value shown in FIG. 4 and found that the graph of the aspect ratio and the Q value has a peak value. The reason is that the effect of reducing the electric resistance at high frequencies due to an increase in the skin area of the coil is dominant from the aspect ratio of 0 to the peak value, and the Q value increases. On the other hand, in the range of the aspect ratio exceeding the peak value, the effect of increasing the electric resistance of the coil wiring due to a decrease in the cross-sectional area of the coil wiring becomes dominant, and the Q value decreases. In contrast, in the conventional example (Japanese Laid-Open Patent Publication No. 2014-107513), the aspect ratio is smaller than 1.0, and it can be seen from FIG. 4 that the Q value is very low.

According to the inductor component 1, the length L of the coil 20 in the axial direction is equal to or greater than 50% of the width H of the element body 10 in the coil axis direction. In this case, the proportion of the coil 20 to the element body 10 can be increased so that the miniaturization can further be achieved with respect to the required coil characteristics. Such a configuration is achieved by disposing the axial direction of the coil 20 along the first and second end surfaces 15, 16 and the bottom surface 17. In particular, since the axis A of the coil 20 does not intersect with the first and second external electrodes 30, 40 and the mounting board, even if the length L of the coil 20 in the axial direction is increased, the coil 20 does not come closer to the first and second external electrodes 30, 40 and the mounting board. Therefore, the coil length can be made longer without increasing the stray capacitance between the coil 20 and each of the first and second external electrodes 30, 40 and the mounting pattern on the mounting board.

Since the length L of the coil 20 in the axial direction is preferably equal to or less than 80% of the width H of the element body 10 in the coil axis direction, a certain amount of the insulating layer without the coil 20 formed thereon can be secured, so that the strength of the element body 10 can be ensured.

Preferably, the wiring width of the coil wiring 21 is 60 μm or less. In this case, the inner diameter of the coil 20 can be ensured and the Q value can be increased. In particular, although the chip size is restricted, a helical coil made up of high-aspect-ratio wirings can be formed while ensuring the inner diameter of the coil 20.

Second Embodiment

Figure 5:
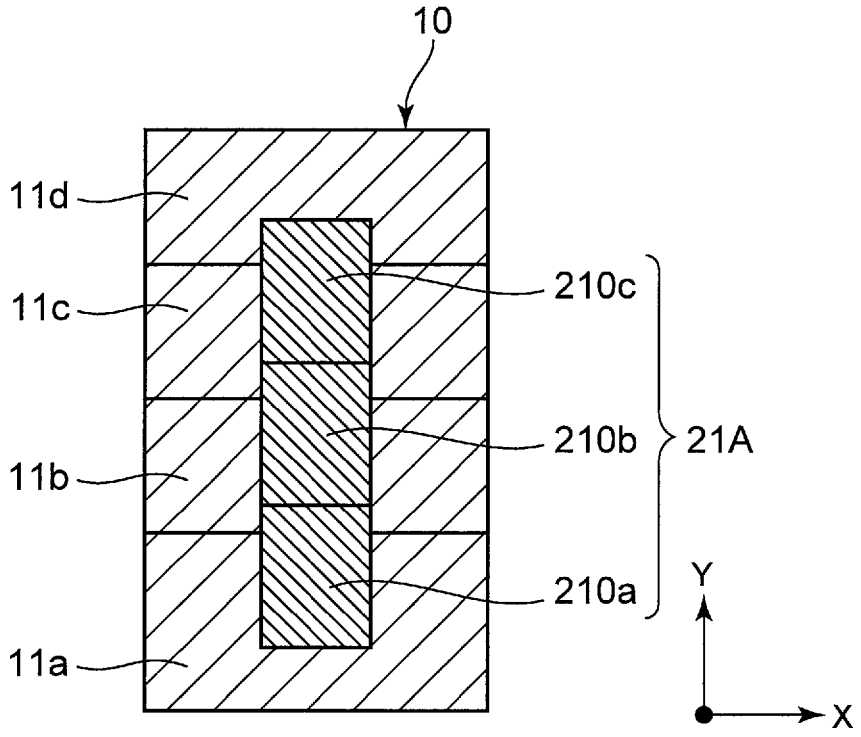
FIG. 5 is a schematic cross-sectional view of a coil wiring of a second embodiment of the inductor component.

FIG. 5 is a schematic cross-sectional view of a second embodiment of the inductor component of the present disclosure. The second embodiment is different from the first embodiment in configuration of coil wirings. This different configuration will hereinafter be described.

Although the coil wiring 21 of the first embodiment is made up of a single layer as shown in FIG. 2, a coil wiring 21A of the second embodiment is made up of three coil conductor layers 210*a* to 210*c* laminated in surface contact with each other as shown in FIG. 5. It is noted that the coil wiring 21A may be made up of two or four or more coil conductor layers.

Specifically, the coil wiring 21A is formed as multiple stages. For example, a first groove is formed in a first insulating layer 11*a*, and the first coil conductor layer 210*a* is embedded in the first groove. Subsequently, a second insulating layer lib is formed on the first insulating layer 11*a*, a second groove is formed in the second insulating layer lib, and the second coil conductor layer 210*b* is embedded in the second groove. Subsequently, a third insulating layer 11*c* is formed on the second insulating layer 11*b*, a third groove is formed in the third insulating layer 11*c*, the third coil conductor layer 210*c* is embedded in the third groove, and a fourth insulating layer 11*d* is formed on the third insulating layer 11*c*. As a result, the first to third coil conductor layers 210*a* to 210*c* are laminated in surface contact with each other to constitute the coil wiring 21A. The first to fourth insulating layers 11*a* to 11*d* are laminated to constitute a portion of the element body 10 and cover the coil wiring 21A. It is noted that the coil conductor layers 210*a* to 210*c* can be formed by a photosensitive paste method in which application of a photosensitive conductive paste is followed by photo-curing of necessary portions for patterning. When the photosensitive conductive paste is applied, the paste is preferably applied by screen printing so as to improve a material usage rate. Alternatively, the coil conductor layers 210*a* to 210*c* may be formed by firing after applying a conductive paste by screen printing etc., or may be formed by a plating method, a sputtering method, etc.

Therefore, according to the configuration of this embodiment, even if it is difficult to form a coil wiring with a high aspect ratio in terms of process, the coil wiring 21A with a high aspect ratio and a high rectangular degree can be formed by laminating a plurality of the coil conductor layers 210*a* to 210*c* to constitute the coil wiring 21A. In particular, since it is no longer necessary to increase the thickness per coil conductor layer for making the aspect ratio higher, the distortion of the cross-sectional shape due to insufficient curing depth of the photosensitive paste or photoresist can be reduced so as to form the coil wiring with the aspect ratio exceeding the limitation of the process.

Figure 6A:
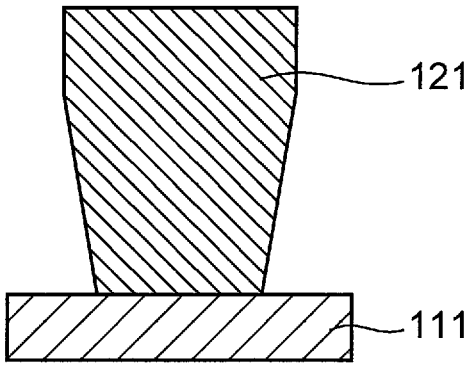
FIG. 6A is an explanatory view for explaining the case of single-stage formation of a coil wiring with a high aspect ratio by a photosensitive paste method.

On the other hand, FIG. 6A shows a shape of the coil wiring 121 in the case of single-stage formation of the coil wiring 121 with a high aspect ratio by a photosensitive paste method, for example. In the photosensitive paste method, a photosensitive conductive paste is applied onto an insulating layer 111, and the paste is then exposed to light in a portion forming the coil wiring 121 and, after an unexposed portion is removed, the coil wiring 121 is formed through sintering. However, if the aspect ratio is high, since the bottom side of the photosensitive conductive paste cannot sufficiently be photo-cured at the time of the exposure and a shrinkage rate becomes larger in a bottom portion than the upper side at the time of sintering, the wiring width of the coil wiring 121 becomes smaller on the bottom side as compared to the upper side, resulting in a distorted shape.

Figure 6B:
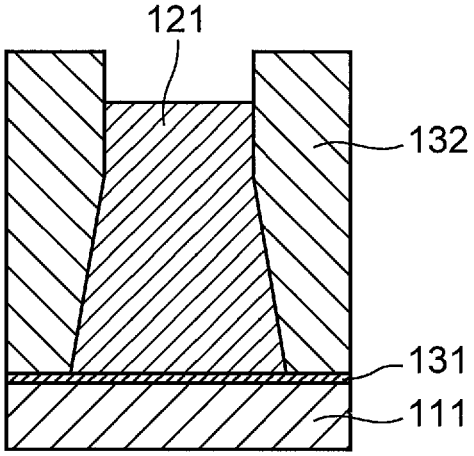
FIG. 6B is an explanatory view for explaining the case of single-stage formation of a coil wiring with a high aspect ratio by a semi-additive method.

FIG. 6B shows a shape of the coil wiring 121 in the case of single-stage formation of the coil wiring 121 with a high aspect ratio by a semi-additive method, for example. In the semi-additive method, a seed layer (intervening layer) 131 is formed on the insulating layer 111 by electroless plating, a photosensitive resist 132 is formed on the seed layer 131, and after the photosensitive resist 132 is removed by photolithography from the portion forming the coil wiring 121, the coil wiring 121 is formed in the removed portion by electrolytic plating using the seed layer 131. However, if the aspect ratio is high, since the bottom side of the photosensitive resist 132 cannot sufficiently be photo-cured at the time of photolithography of the photosensitive resist 132 and the bottom side is removed more than necessary during etching, the wiring width of the coil wiring 121 becomes larger on the bottom side as compared to the upper side, resulting in a distorted shape.

Such a problem of the shape of the coil wiring essentially occurs also in screen printing, other plating methods, a sputtering method, etc., and each process has a restriction on the aspect ratio for forming a coil wiring having a stable shape.

On the other hand, since the coil wiring 21A of this embodiment is formed as multiple stages, the coil conductor layers 210*a* to 210*c* are formed within a depth range having no influence on photo-curing depth in the grooves of the insulating layers 11*a* to 11*c*, so that the coil conductor layers 210*a* to 210*c* become rectangular. As a result, the current density distribution is stabilized at high frequencies.

Additionally, since this embodiment eliminates an unexposed portion in the bottom portion of the coil wiring 21A in the photosensitive paste method, a void after firing is hardly generated due to a difference in shrinkage amount during firing.

In the structure of this embodiment, no intervening layer such as the seed layer 131 of FIG. 6B exists between the coil conductor layers 210*a*, 210*b*, 210*c* in surface contact and between the coil conductor layers 210*a*, 210*b*, 210*c* and the element body 10. Therefore, the adhesion strength of the coil wiring 121 does not deteriorate due to differences in process between a portion formed by electroless plating (the seed layer 131) and a portion formed by electrolytic plating in the coil wiring, a difference in material between the coil wiring 121 and the insulating layer 111, etc. As a result, the adhesion strength can be prevented from deteriorating between the coil conductor layers 210*a* to 210*c* formed as multiple stages, and the adhesion strength can be prevented from deteriorating between the coil conductor layers 210*a* to 210*c* and the element body 10.

Moreover, the aspect ratio of the coil conductor layers 210*a* to 210*c* is preferably 2.0 or less and the coil wiring with a high aspect ratio can stably be formed. Therefore, a reduction is achieved in the influence of distortion of the shape of the coil wiring 21A due to an insufficient curing depth of the photosensitive paste or photoresist.

In FIG. 5, the interfaces of the coil conductor layers 210*a* to 210*c* are shown; however, the interfaces actually become less conspicuous due to firing and the coil conductor layers 210*a* to 210*c* may substantially be integrated in some cases.

Third Embodiment

Figure 7:
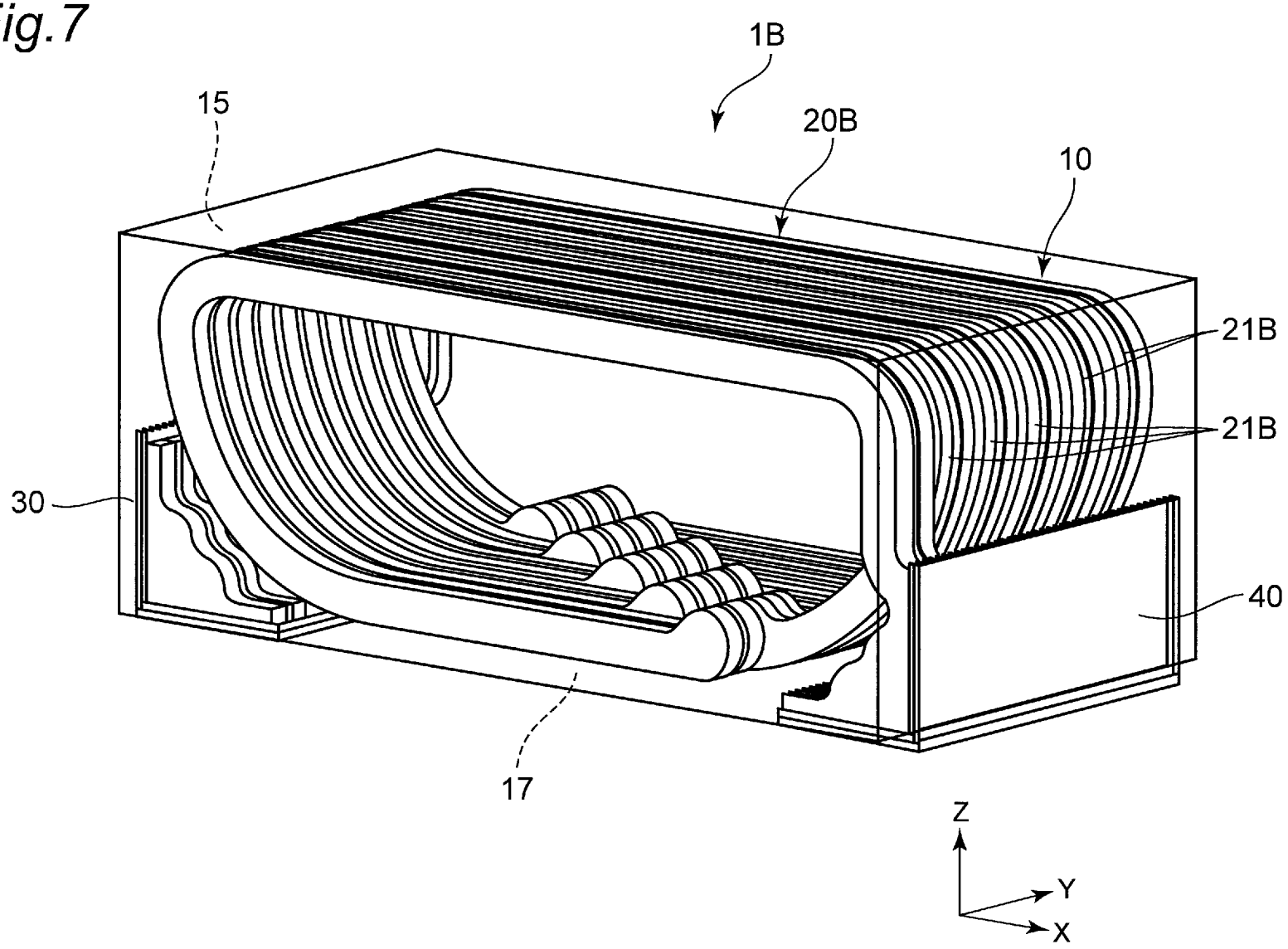
FIG. 7 is a transparent perspective view of a third embodiment of the inductor component.
Figure 8:
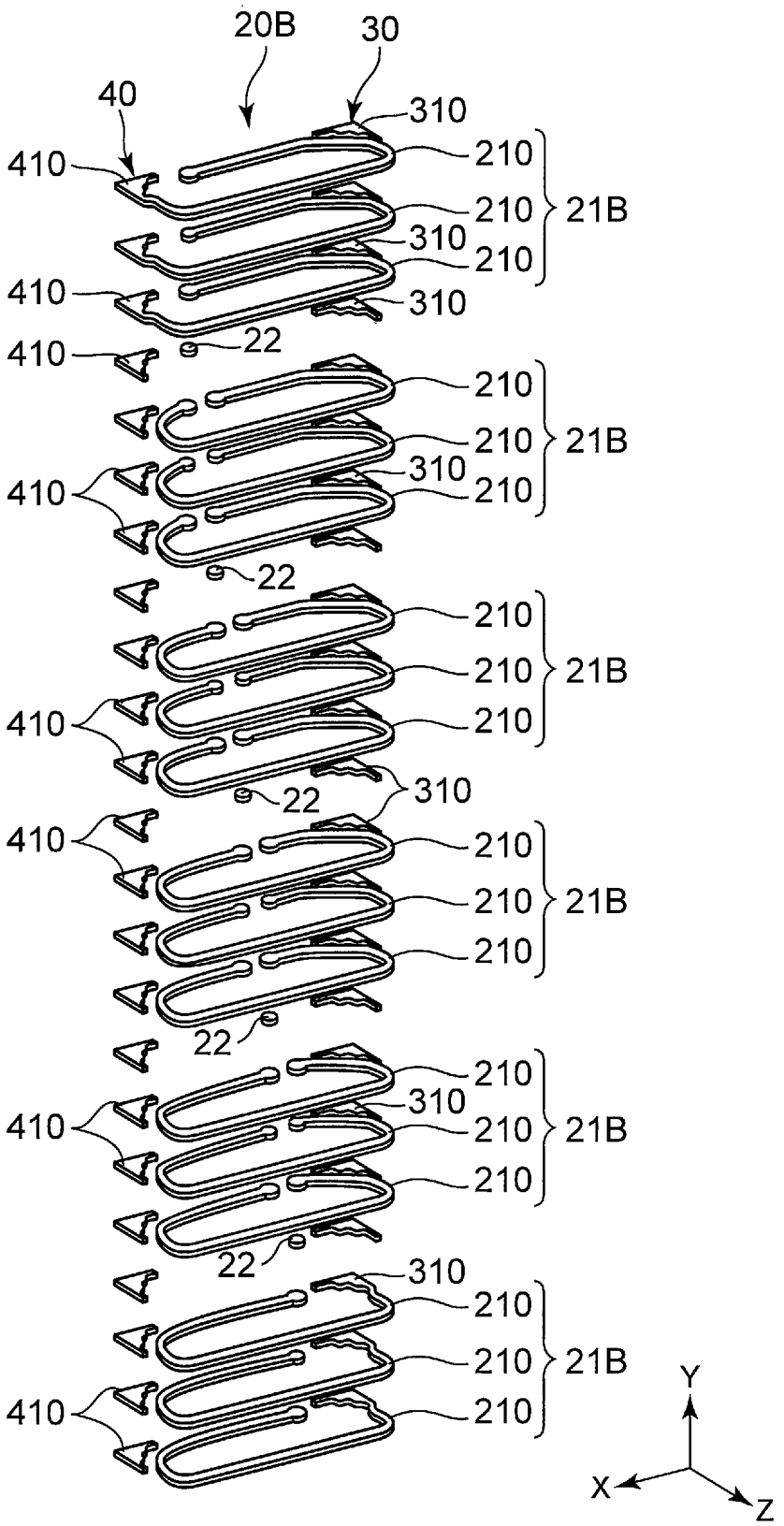
FIG. 8 is an exploded perspective view of the inductor component.

FIG. 7 is a transparent perspective view of a third embodiment of the inductor component of the present disclosure. FIG. 8 is an exploded perspective view of the inductor component.

In FIG. 7, a coil 20B and the first and second external electrodes 30, 40 are indicated by solid lines. In FIG. 8, the insulating layers of the element body 10 are not shown. The third embodiment is different from the first embodiment in the configuration of the coil wirings. This different configuration will hereinafter be described.

Although the coil wiring 21 of the first embodiment is made up of a single layer as shown in FIG. 2, coil wirings 21B of the coil 20B of an inductor component 1B of the third embodiment are each made up of three laminated coil conductor layers 210 as shown in FIGS. 7 and 8. The adjacent coil wirings 21B are electrically connected in series through via wirings 22. The first external electrode 30 is made up of a plurality of electrode conductor layers 310 embedded and laminated in the element body 10. The second external electrode 40 is made up of a plurality of electrode conductor layers 410 embedded and laminated in the element body 10. Therefore, since the coil wiring 21B is made up of a plurality of the coil conductor layers 210, the coil wiring 21B with a high aspect ratio and a high rectangular degree can be formed as described in the second embodiment.

Figure 9:
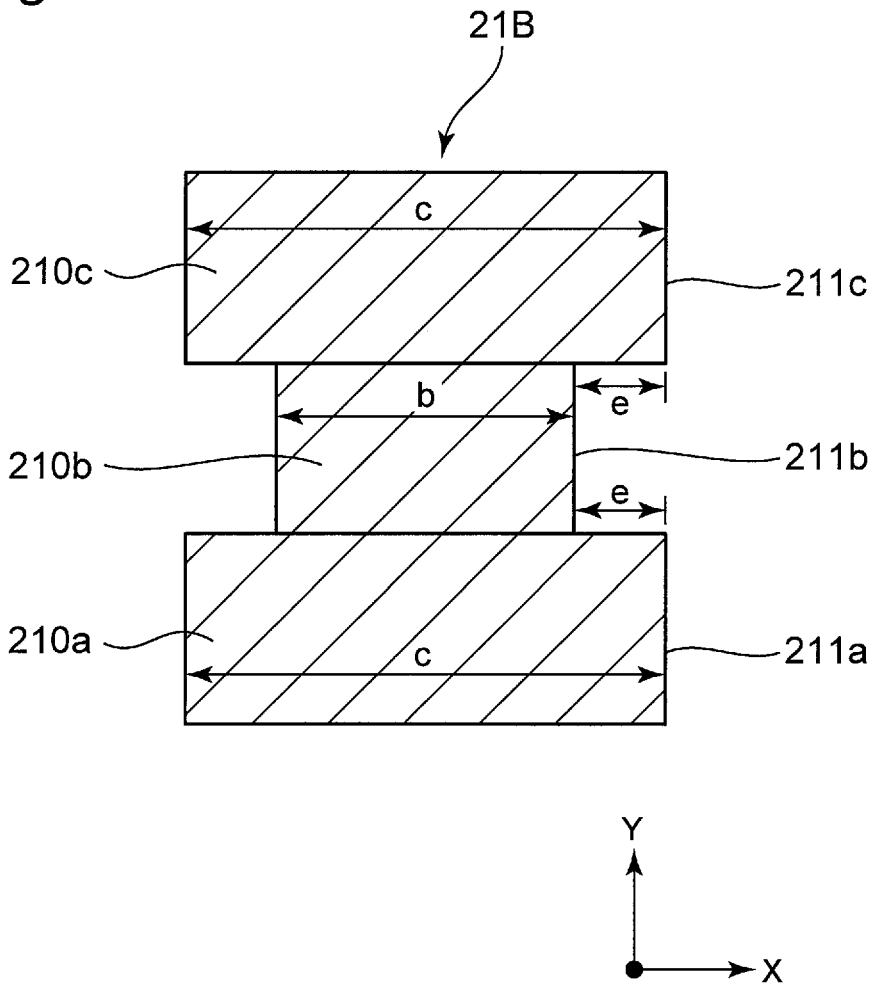
FIG. 9 is a schematic cross-sectional view of the coil wiring.

FIG. 9 is a schematic cross-sectional view of the coil wiring 21B. The coil wiring 21B is made up of the first coil conductor layer 210*a*, the second coil conductor layer 210*b*, and the third coil conductor layer 210*c*. The first coil conductor layer 210*a*, the second coil conductor layer 210*b*, and the third coil conductor layer 210*c* are arranged in order along the axial direction (Y direction) of the coil. The cross section of FIG. 9 is a transverse cross section of the coil wiring 21B as is the case with FIG. 3, and the right side of the drawing (the X-axis direction side) is the inner surface side (inner side) of the coil wiring 21B and the coil conductor layers 210, while the left side of the drawing (the side opposite to the X-axis direction) is the outer surface side (outer side) of the coil wiring 21B and the coil conductor layers 210.

A wiring width c of the first coil conductor layer 210*a* and the third coil conductor layer 210*c* is greater than a wiring width b of the second coil conductor layer 210*b*. Therefore, the coil wiring 21B varies in the wiring width along the axial direction.

The center of the inner diameter of the first and third coil conductor layers 210*a*, 210*c* and the center of the inner diameter of the second coil conductor layer 210*b* coincide with each other in the coil radial direction, and the transverse cross-sectional shape of FIG. 9 is the same across the wiring length of the coil wiring 21B. In this case, a ratio (a/c) of a difference a between the maximum wiring width c and the minimum wiring width b of the coil wiring 21B to the maximum wiring width c is 40% or less.

Therefore, a gap between inner surfaces 211*a*, 211*c* of the first and third coil conductor layers 210*a*, 210*c* and an inner surface 211*b* of the second coil conductor layer 210*b* is suppressed to a certain level or less (the rectangularity of the coil wiring 21B is ensured) so that the inner surface of the coil wiring 21B can be restrained from decreasing in area of the region in which the current density of the high frequency signal is high (substantial coil skin area). As a result, a resistance loss at high frequencies can be suppressed to improve the Q value.

The ratio (a/c) is preferably 5% or less. As a result, the resistance loss at high frequencies can be more suppressed to further improve the Q value.

Figure 10A:
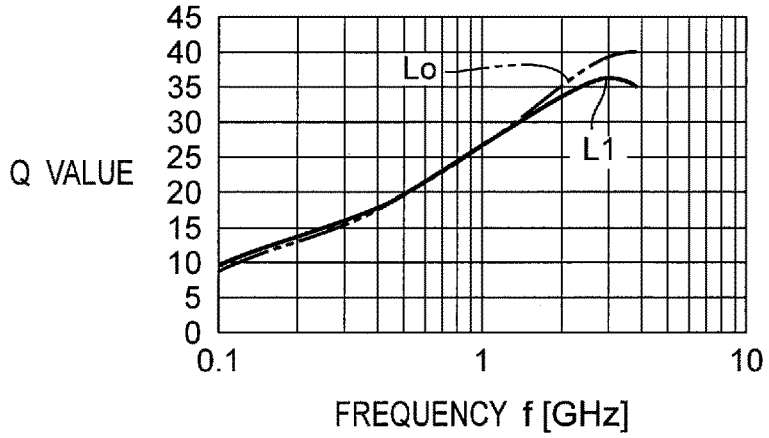
FIG. 10A is a graph of a relationship between the signal frequency and the Q value of the inductor component when a ratio (a/c) is 20%.
Figure 10B:
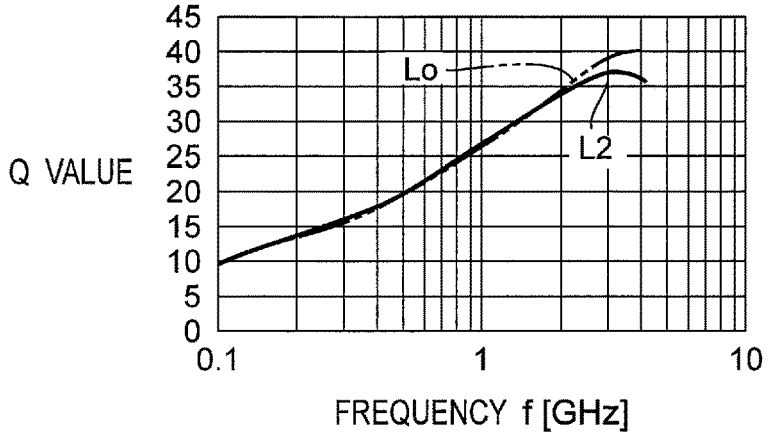
FIG. 10B is a graph of a relationship between the signal frequency and the Q value of the inductor component when the ratio (a/c) is 5%.
Figure 10C:
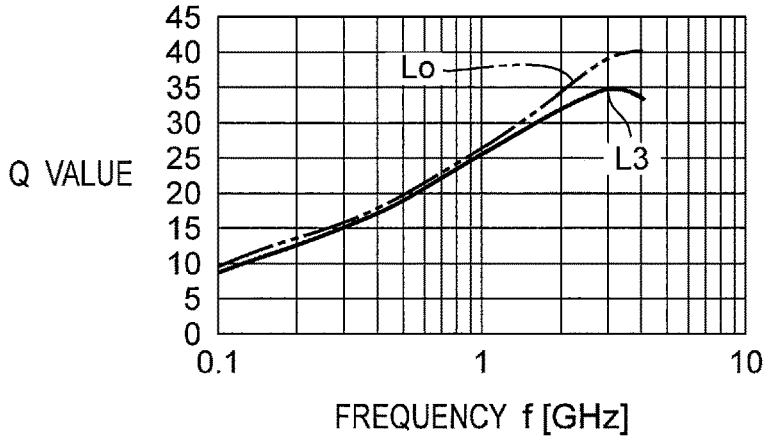
FIG. 10C is a graph of a relationship between the signal frequency and the Q value of the inductor component when the ratio (a/c) is 30%.

FIGS. 10A to 10C show a relationship between the signal frequency and the Q value of the inductor component when the ratio (a/c) is changed. FIG. 10A shows a state when the ratio (a/c) is 40% as a graph L1, FIG. 10B shows a state when the ratio (a/c) is 10% as a graph L2, and FIG. 10C shows a state when the ratio (a/c) is 60% as a graph L3. FIGS. 10A to 10C also show a state when the ratio (a/c) is 0%, i.e., when the widths of all the coil conductor layers are the same and the inner surfaces of all the coil conductor layers have no gap, as a graph L0.

First, when the ratio (a/c) is 0%, since no gap exists between the inner surfaces of the coil conductor layers, the constant skin area is ensured and no reduction is seen in the Q value even when a signal frequency f reaches a high frequency exceeding 2 GHz as shown in the graph L0. On the other hand, when the ratio (a/c) exceeds 0% and a gap exists between the inner surfaces of the coil conductor layers, the current density of the high frequency signal becomes lower in the inner surface of the coil conductor layer having the smaller wiring width (the coil conductor layer 210 *b* of FIG. 9) and the skin area decreases as the signal frequency f becomes higher, so that the resistance loss at high frequencies increases. Specifically, as shown in the graphs L1 to L3, a reduction in the Q value occurs in a region exceeding a certain frequency as compared to the graph L0. However, when the ratio (a/c) is 40%, as shown in FIG. 10A, the Q value is not reduced even at signal frequencies exceeding 1 GHz. Furthermore, when the ratio (a/c) is 10%, as shown in FIG. 10B, the Q value is not reduced even at signal frequencies around 2 GHz. When the ratio (a/c) is 60%, as shown in FIG. 10C, a reduction in the Q value is seen as compared to the graph L0 even at a signal frequency of 1 GHz or less, and the Q value is clearly reduced as compared to the graph L0 at signal frequencies exceeding 1 GHz.

Instead of the ratio (a/c), the following ratio may be used for making the evaluation. As shown in FIG. 9, the inner surfaces 211*a*, 211*c* of the first and third coil conductor layers 210*a*, 210*c* are shifted inward (to the X-direction side) from the inner surface 211*b* of the second coil conductor layer 210*b*. In other words, the inner surfaces 211*a* to 211*c* of the coil wiring 21B project to the inner side of the coil wiring 21B. In this case, a ratio (e/c) of a projection amount e of the inner surfaces 211*a* to 211*c* to the maximum width c of the coil wiring 21B is 20% or less, preferably 5% or less. In this way, for the improvement in the Q value due to suppression of the resistance loss at high frequencies, attention may be paid to the inner surfaces 211*a* to 211*c* of the coil wiring 21B, i.e., the coil conductor layers 210*a* to 210*c*, constituting the skin area and, in this case, a gap amount or a protrusion amount of the outer surfaces of the coil wiring 21B, i.e., the coil conductor layers 210*a* to 210*c*, may have any value. In this case, the center of the first and third coil conductor layers 210*a*, 210*c* in the coil radial direction and the center of the second coil conductor layer 210*b* in the coil radial direction may be shifted with respect to the coil radial direction.

In this embodiment, as shown in FIG. 9, the transverse cross section of the coil wiring 21B has an I shape; however, for example, the coil wiring 21B may be made up of only the first and second coil conductor layers 210*a*, 210*b* or only the second and the third coil conductor layers 210*b*, 210*c* to form the transverse cross section of the coil wiring 21B into a T shape.

Furthermore, the transverse cross section of the coil wiring 21B may have a stacked shape of T. For example, when three or more coil conductor layers constitute the one coil wiring 21B, a coil conductor layer having a small wiring width and a coil conductor layer having a large wiring width may alternately be laminated.

Figure 11A:
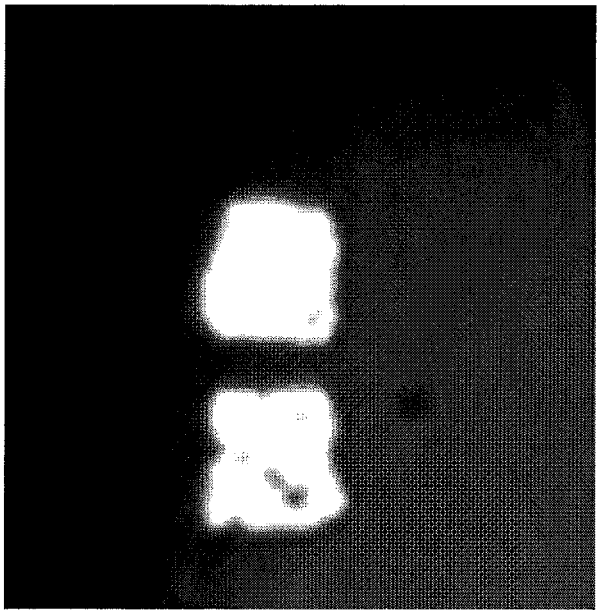
FIG. 11A is a cross-sectional picture of a coil wiring having a cross-sectional shape that is an I-shape.
Figure 11B:
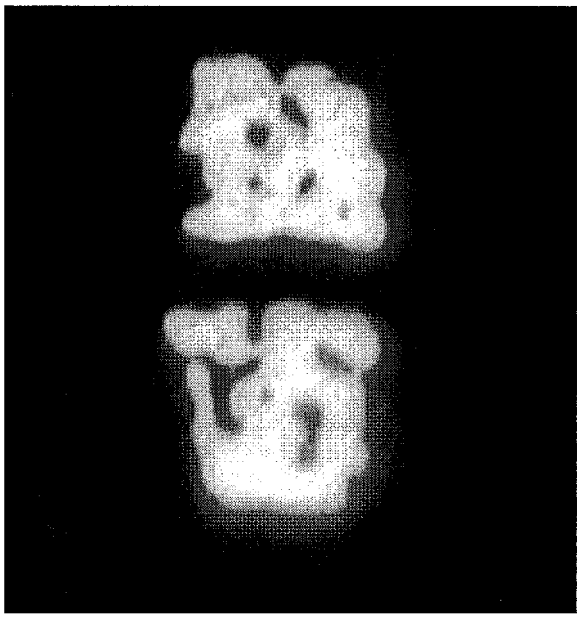
FIG. 11B is a cross-sectional picture of a coil wiring having a cross-sectional shape that is a T-shape.

Although shown as an easily-understandable simplified manner in FIG. 9, the I-shaped transverse cross section is a shape shown in FIG. 11A in an actual cross-sectional picture. The T-shaped transverse cross section is a shape shown in FIG. 11B in an actual cross-sectional picture. In FIG. 11B, a lower coil wiring shows a T shape and an upper coil wiring shows an inverted T shape.

When the transverse cross section of the coil wiring 21B has a T shape, an I shape, or a stacked shape of T as described above, the coil wiring 21B with a high aspect ratio can stably be formed. In particular, in the case of a method of forming a high-aspect-ratio coil wiring by embedding and connecting materials of coil conductor layers in a groove formed in an insulating layer, the groove width formed in the insulating layer can be made narrower than the wiring width of the coil conductor layer so as to prevent the coil wiring from being defectively formed due to a deviation of the formation position of the coil conductor layer.

Figure 12A:
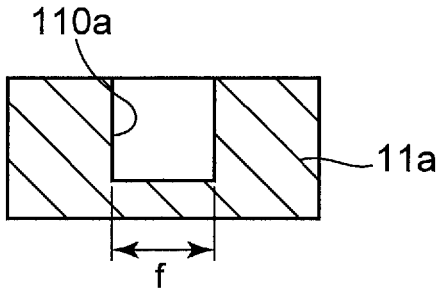
FIG. 12A is an explanatory view for explaining a method of forming a coil conductor layer such that the coil conductor layer has a width made larger than a width of a groove of an insulating layer.
Figure 12B:
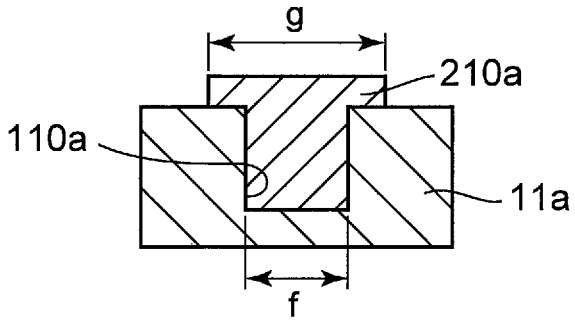
FIG. 12B is an explanatory view for explaining the method of forming a coil conductor layer such that the coil conductor layer has a width made larger than a width of a groove of an insulating layer.

Description will hereinafter specifically be made with reference to FIGS. 12A to 12D corresponding to the transverse cross section of the coil wiring. As shown in FIG. 12A, a first groove 110*a* is formed in the first insulating layer 11*a* by a photolithography step etc. In FIG. 12A, the depth of the first groove 110*a* is smaller than the thickness of the first insulating layer 11*a*, and this can be achieved by, for example, a photolithographic method using a halftone mask, or a known method such as forming the first insulating layer 11*a* made up of two layers. The first groove 110*a* may be formed to a depth penetrating the first insulating layer 11*a*. Subsequently, as shown in FIG. 12B, a photosensitive conductive paste is applied onto the first insulating layer 11*a* and into the first groove 110*a* by screen printing to form a photosensitive conductive paste layer. Ultraviolet rays etc. are then applied through a photomask to the photosensitive conductive paste layer and followed by development with a developing solution such as an alkaline solution. As a result, the first coil conductor layer 210*a* is formed on the first insulating layer 11*a* and in the first groove 110*a*. At this step, a wiring width g of the first coil conductor layer 210*a* is made larger than a width f of the first groove 110*a* by using the pattern design of the photomask.

Figure 12C:
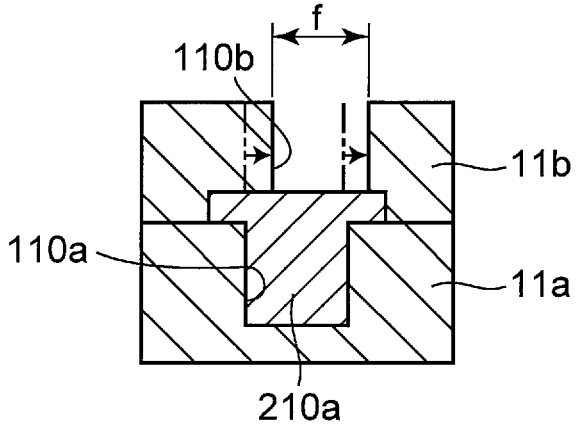
FIG. 12C is an explanatory view for explaining the method of forming a coil conductor layer such that the coil conductor layer has a width made larger than a width of a groove of an insulating layer.

Subsequently, as shown in FIG. 12C, a second insulating layer 11*b* is formed on the first insulating layer 11*a*. A second groove 110*b* is then formed in the second insulating layer 11*b* by a photolithography step etc. It is assumed that the second groove 110*b* is formed at a position deviated from the correct position indicated by imaginary lines due to misalignment etc. of a mask at the photolithography step.

Figure 12D:
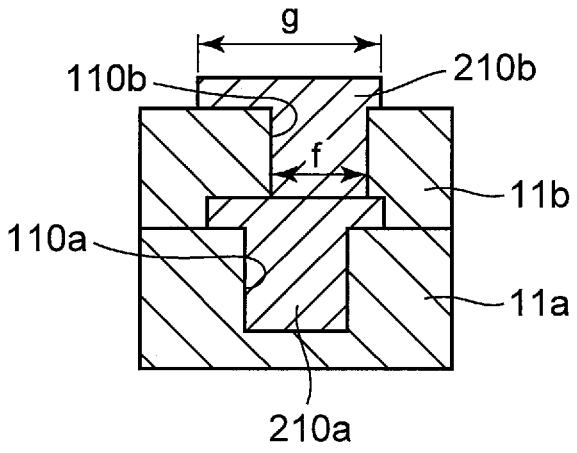
FIG. 12D is an explanatory view for explaining the method of forming a coil conductor layer such that the coil conductor layer has a width made larger than a width of a groove of an insulating layer.

Subsequently, as shown in FIG. 12D, a photosensitive conductive paste is applied onto the second insulating layer 11*b* and into the second groove 110*b* by screen printing to form a photosensitive conductive paste layer. Ultraviolet rays etc. are then applied through a photomask to the photosensitive conductive paste layer and followed by development with a developing solution such as an alkaline solution. As a result, the second coil conductor layer 210*b* is formed on the second insulating layer 11*b* and in the second groove 110*b*. At this time, even though the second groove 110*b* is formed at a deviated position, the wiring width g of the second coil conductor layer 210*b* is larger than the width f of the second groove 110*b* and, therefore, the second coil conductor layer 210*b* is filled into the second groove 110*b*.

Figure 13A:
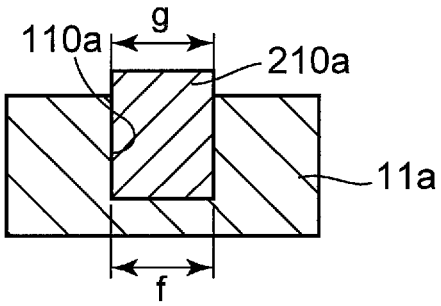
FIG. 13A is an explanatory view for explaining a method of forming a coil conductor layer such that the coil conductor layer has a width made equal to a width of a groove of an insulating layer.

On the other hand, the case of forming the width f of the groove formed in the insulating layer and the wiring width g of the coil conductor layers as the same width, i.e., the case of making the width f of the first and second grooves 110*a*, 110*b* equal to the wiring width g of the coil conductor layers 210*a*, 210*b*, will be described with reference to FIGS. 13A to 13D also corresponding to the transverse cross section of the coil wiring. First, as shown in FIG. 13A, the first groove 110*a* is formed in the first insulating layer 11*a*, and a photosensitive conductive paste is applied into the first groove 110*a* by screen printing to form a photosensitive conductive paste layer. Ultraviolet rays etc. are then applied through a photomask to the photosensitive conductive paste layer and followed by development with a developing solution such as an alkaline solution. In this way, when the formation position of the first groove 110*a* coincides with the formation position of the first coil conductor layer, the first coil conductor layer 210*a* is formed in the first groove 110*a*.

Figure 13B:
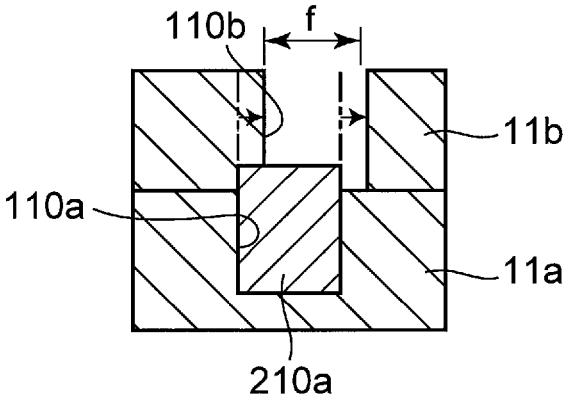
FIG. 13B is an explanatory view for explaining the method of forming a coil conductor layer such that the coil conductor layer has a width made equal to a width of a groove of an insulating layer.

Subsequently, as shown in FIG. 13B, the second insulating layer 11*b* is formed on the first insulating layer 11*a*. The second groove 110*b* is then formed in the second insulating layer 11*b* by a photolithography step etc. It is assumed that the second groove 110*b* is formed at a position deviated from the correct position indicated by imaginary lines due to misalignment etc. of a mask at the photolithography step.

Figure 13C:
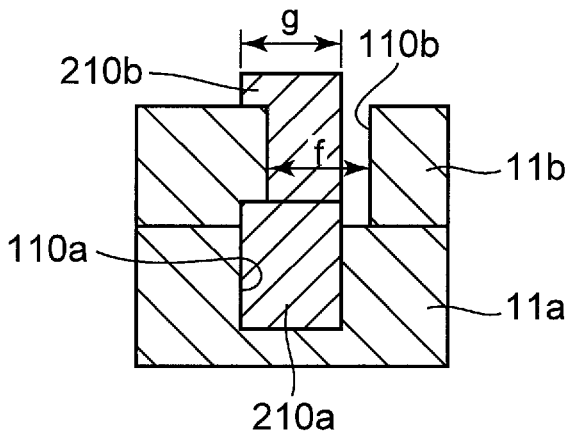
FIG. 13C is an explanatory view for explaining the method of forming a coil conductor layer such that the coil conductor layer has a width made equal to a width of a groove of an insulating layer.
Figure 13D:
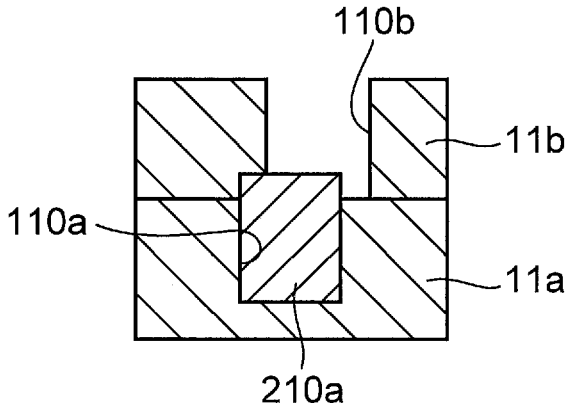
FIG. 13D is an explanatory view for explaining the method of forming a coil conductor layer such that the coil conductor layer has a width made equal to a width of a groove of an insulating layer.

Subsequently, as shown in FIG. 13C, a photosensitive conductive paste is applied onto the second insulating layer 11*b* and into the second groove 110*b* by screen printing to form a photosensitive conductive paste layer. Ultraviolet rays etc. are then applied through a photomask to the photosensitive conductive paste layer and followed by development with a developing solution such as an alkaline solution to form the second coil conductor layer 210*b*. In this case, if the second groove 110*b* is formed at the deviated position, the photosensitive conductive paste layer is not filled into the second groove 110*b* because the width f of the second groove 110*b* is the same as the width g of the second coil conductor layer 210*b*. In particular, since the second groove 110 *b* is deviated from the position of application by screen printing, a gap is formed between the photosensitive conductive paste layer to be the second coil conductor layer 210*b* and the second groove 110*b*. As a result, at the photolithography step for the photosensitive conductive paste layer, the developing solution enters from the gap of the second groove 110*b*. The lower layer side of the photosensitive conductive paste layer is less photo-cured as compared to the upper layer side and therefore may possibly be removed by the developing solution and, in this case, as shown in FIG. 13D, the second coil conductor layer 210*b* may peel from the second groove 110*b*.

It is noted that if the formation position of the second groove 110*b* is deviated as shown in FIG. 13B, the photosensitive conductive paste layer can be filled into the second groove 110*b* by giving a margin to the shape of application of the photosensitive conductive paste by screen printing at the time of forming the second coil conductor layer 210*b*. However, even in this case, since the exposure position of the photosensitive conductive paste at the photolithography step is deviated from the formation position of the second groove 110*b*, a portion of the photosensitive conductive paste layer filled in the second groove 110*b* is not photo-cured and is removed by development, so that a gap is formed in the second groove 110*b*. Therefore, as shown in FIG. 13D, the second coil conductor layer 210*b* may peel from the second groove 110*b* due to the developing solution.

Furthermore, although the case of deviation of the formation position of the second groove 110*b* has been described as above, even when the formation position of the second groove 110*b* is not deviated, the same problem may occur at the time of formation of the second coil conductor layer 210*b* due to a deviation of the mask of the screen printing or a deviation of the photomask of the photolithography step. Therefore, preferably, the transverse cross section of the coil wiring 21B has a T shape, an I shape, or a stacked shape of T.

Although the ratio in the mutual relationship of wiring widths of a plurality of coil conductor layers is described in the third embodiment, the plurality of the coil conductor layers may have the first coil conductor layer and the second coil conductor layer having the same wiring width. In this case, for example, the center of the inner diameter of the first coil conductor layer may deviate from the center of the inner diameter of the second coil conductor layer. Even in this case, a ratio (d/c) of a deviation amount d between the center of the wiring width of the first coil conductor layer and the center of the wiring width of the second coil conductor layer to the wiring width c of the first coil conductor layer and the second coil conductor layer is preferably 20% or less, more preferably 5% or less. In this case, the deviation between the inner surface of the first coil conductor layer and the inner surface of the second coil conductor layer is suppressed, so that the resistance loss at high frequencies can be suppressed to improve the Q value.

Fourth Embodiment

FIG. 14A to 14J are explanatory views of a method of manufacturing of a fourth embodiment of the inductor component of the present disclosure. The fourth embodiment is different from the second embodiment in the configuration of the coil wirings. This different configuration will hereinafter be described.

Figure 14A:
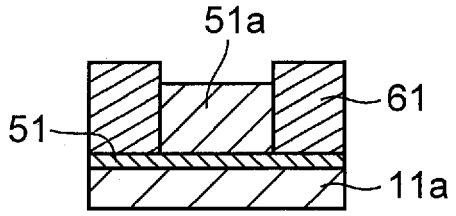
FIG. 14A is an explanatory view for explaining a method of manufacturing a coil wiring of a fourth embodiment of the inductor component.
Figure 14B:
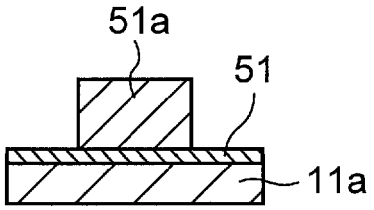
FIG. 14B is an explanatory view for explaining the method of manufacturing the coil wiring of the fourth embodiment of the inductor component.
Figure 14C:
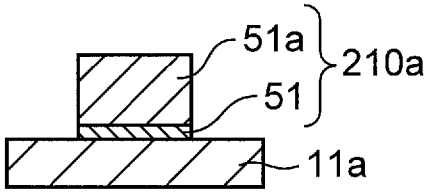
FIG. 14C is an explanatory view for explaining the method of manufacturing the coil wiring of the fourth embodiment of the inductor component.
Figure 14D:
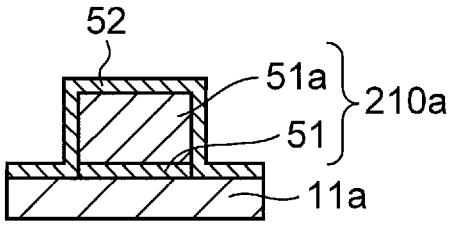
FIG. 14D is an explanatory view for explaining the method of manufacturing the coil wiring of the fourth embodiment of the inductor component.
Figure 14E:
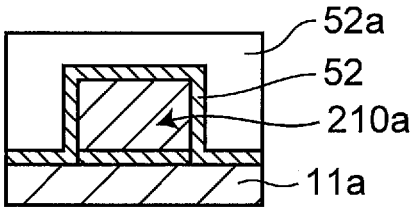
FIG. 14E is an explanatory view for explaining the method of manufacturing the coil wiring of the fourth embodiment of the inductor component.
Figure 14F:
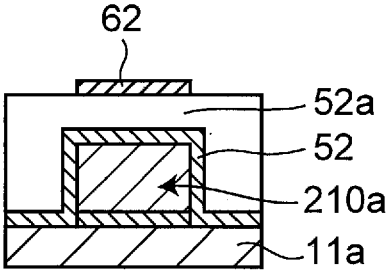
FIG. 14F is an explanatory view for explaining the method of manufacturing the coil wiring of the fourth embodiment of the inductor component.
Figure 14G:
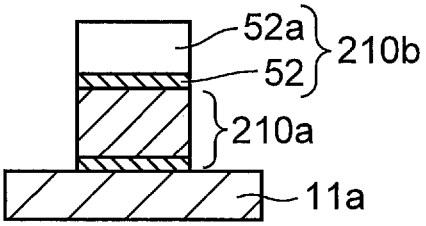
FIG. 14G is an explanatory view for explaining the method of manufacturing the coil wiring of the fourth embodiment of the inductor component.
Figure 14H:
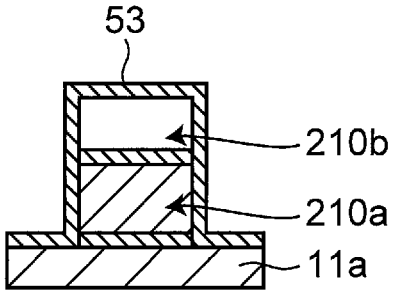
FIG. 14H is an explanatory view for explaining the method of manufacturing the coil wiring of the fourth embodiment of the inductor component.
Figure 14I:
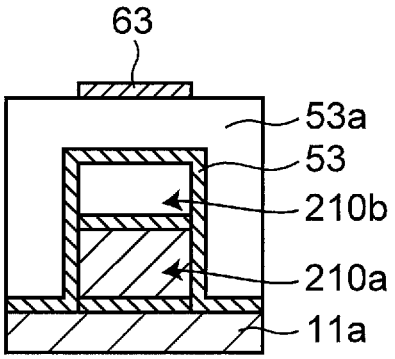
FIG. 14I is an explanatory view for explaining the method of manufacturing the coil wiring of the fourth embodiment of the inductor component.
Figure 14J:
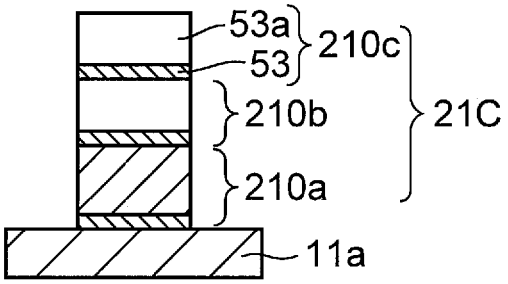
FIG. 14J is an explanatory view for explaining the method of manufacturing the coil wiring of the fourth embodiment of the inductor component.

Although the coil wiring 21A of the second embodiment has no intervening layer between the adjacent coil conductor layers and between the coil conductor layers and the element body as shown in FIG. 5, a coil wiring 21C of the fourth embodiment has seed layers 51, 52, 53 as an example of the intervening layer, as shown in FIG. 14J, in at least a portion between the adjacent coil conductor layers 210*a* to 210*c* and between the coil conductor layer 210*a* and the insulating layer 11*a* (element body). Therefore, a method requiring the interfaces of the seed layers 51, 52, 53 can be permitted for forming the coil wiring 21C. For example, a semi-additive method is applicable that is advantageous for forming the high-aspect-ratio coil wiring and lowering the resistance of the coil wiring as compared to the method using a conductive paste.

A method of manufacturing the coil wiring 21C will be described.

As shown in FIG. 14A, the first seed layer 51 is formed on the first insulating layer 11*a* by electroless plating, for example, and a photosensitive first resist 61 is formed on the first seed layer 51, and a portion of the first resist 61 is removed at the position of formation of the first coil conductor layer 210*a*. A first plating growth layer 51*a* is formed to fill the removed portion of the first resist 61 by electrolytic plating through the first seed layer 51. As shown in FIG. 14B, the first resist 61 is peeled off and, as shown in FIG. 14C, the first seed layer 51 is etched except under the plating growth layer 51*a*. In this way, the first coil conductor layer

210*a* made up of the first seed layer 51 and the first plating growth layer 51*a* is formed by the semi-additive method.

Subsequently, as shown in FIG. 14D, the second seed layer 52 is formed on the first insulating layer 11*a* and on the first coil conductor layer 210*a* and, as shown in FIG. 14E, a second plating growth layer 52*a* is formed by electrolytic plating through the second seed layer 52.

As shown in FIG. 14F, a second resist 62 is formed on a portion on the second plating growth layer 52*a* (a portion above the first coil conductor layer 210*a*) and, as shown in FIG. 14G, a portion of the second plating growth layer 52*a* and a portion of the second seed layer 52 not covered with the second resist 62 are etched, and the second resist 62 is peeled off. As a result, the second coil conductor layer 210*b* made up of the second seed layer 52 and the second plating growth layer 52*a* is formed.

Subsequently, as shown in FIG. 14H, a third seed layer 53 is formed on the first insulating layer 11*a* and the second coil conductor layer 210*b* and, as shown in FIG. 14I, a third plating growth layer 53*a* is formed by electrolytic plating through the third seed layer 53, and a third resist 63 is formed on a portion on the third plating growth layer 53*a* (a portion above the second coil conductor layer 210*b*).

As shown in FIG. 14J, a portion of the third plating growth layer 53*a* and a portion of the third seed layer 53 not covered with the third resist 63 are etched, and the third resist 63 is peeled off to form the third coil conductor layer 210*c* made up of the third seed layer 53 and the third plating growth layer 53*a*. As a result, the coil wiring 21C made up of the first coil conductor layer 210*a*, the second coil conductor layer 210*b*, and the third coil conductor layer 210*c* is formed.

As described above, the first coil conductor layer 210*a* is a portion of the plurality of the coil conductor layers and is formed by the semi-additive method. Therefore, as compared to the method using a conductive paste, this is advantageous for forming the high-aspect-ratio coil wiring and lowering the resistance of the coil wiring.

The second coil conductor layer 210*b* and the third coil conductor layer 210*c* are portions of the plurality of the coil conductor layers and are formed by plating growth. Therefore, as compared to the method using a conductive paste, this is more advantageous for forming the high-aspect-ratio coil wiring and lowering the resistance of the coil wiring.

Figure 15A:
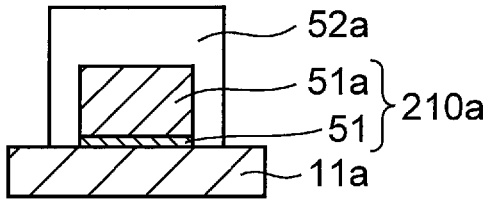
FIG. 15A is an explanatory view for explaining the method of manufacturing another coil wiring of the fourth embodiment of the inductor component.
Figure 15B:
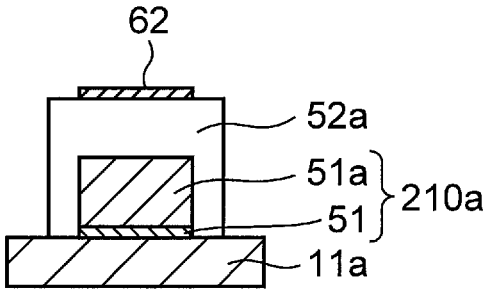
FIG. 15B is an explanatory view for explaining the method of manufacturing another coil wiring of the fourth embodiment of the inductor component.
Figure 15C:
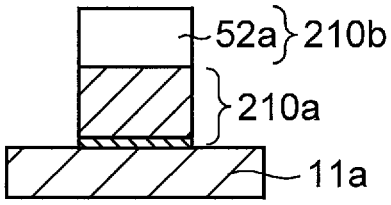
FIG. 15C is an explanatory view for explaining the method of manufacturing another coil wiring of the fourth embodiment of the inductor component.
Figure 15D:
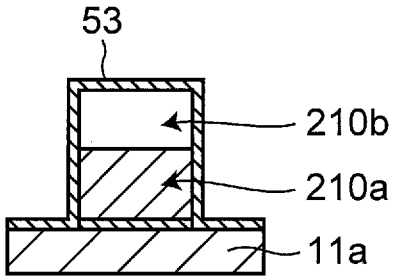
FIG. 15D is an explanatory view for explaining the method of manufacturing another coil wiring of the fourth embodiment of the inductor component.
Figure 15E:
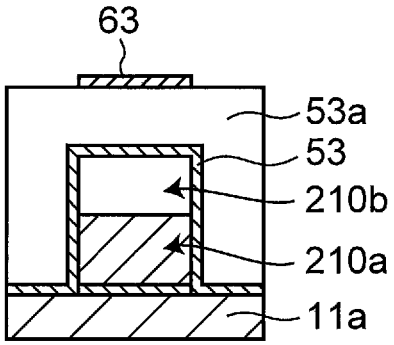
FIG. 15E is an explanatory view for explaining the method of manufacturing another coil wiring of the fourth embodiment of the inductor component.
Figure 15F:
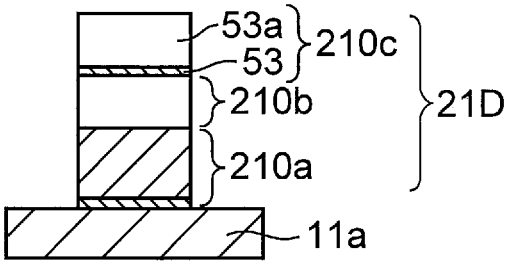
FIG. 15F is an explanatory view for explaining the method of manufacturing another coil wiring of the fourth embodiment of the inductor component.

In the method of manufacturing the coil wiring 21C, a coil wiring 21D shown in FIG. 15F may be manufactured without forming the second seed layer 52 shown in FIG. 14D.

A method of manufacturing the coil wiring 21D will be described.

As shown in FIGS. 14A to 14C, the first coil conductor layer 210*a* is formed by the semi-additive method. Subsequently, as shown in FIG. 15A, the second plating growth layer 52*a* is formed on the first coil conductor layer 210*a* by electrolytic plating without forming the second seed layer 52 shown in FIG. 14D. It is noted that although the first seed layer 51 is etched in FIG. 14C, the electrolytic plating can be achieved by connecting the first coil conductor layer 210*a* through a feed line not shown. This feed line can be removed by a cutting step of a laminated body described later.

As shown in FIG. 15B, the second resist 62 is formed on a portion on the second plating growth layer 52*a* (a portion above the first coil conductor layer 210*a*) and, as shown in FIG. 15C, a portion of the second plating growth layer 52*a* not covered with the second resist 62 is etched, and the second resist 62 is peeled off. As a result, the second coil conductor layer 210*b* is formed.

Subsequently, as shown in FIG. 15D, the third seed layer 53 is formed on the first insulating layer 11*a* and the second coil conductor layer 210*b* and, as shown in FIG. 15E, the third plating growth layer 53*a* is formed by electrolytic plating through the third seed layer 53, and the third resist 63 is formed on a portion on the third plating growth layer 53*a* (a portion above the second coil conductor layer 210*b*).

As shown in FIG. 15F, a portion of the third plating growth layer 53*a* and a portion of the third seed layer 53 not covered with the third resist 63 are etched, and the third resist 63 is peeled off to form the third coil conductor layer 210*c* made up of the third seed layer 53 and the third plating growth layer 53*a*. As a result, the coil wiring 21D made up of the first coil conductor layer 210*a*, the second coil conductor layer 210*b*, and the third coil conductor layer 210*c* is formed.

In the coil wiring 21D, the third coil conductor layer 210*c* serving as a portion of the plurality of the coil conductor layers may further be formed by plating growth without forming the third seed layer 53. As compared to the method using a conductive paste, this is more advantageous for forming the high-aspect-ratio coil wiring and lowering the resistance of the coil wiring.

Figure 16:
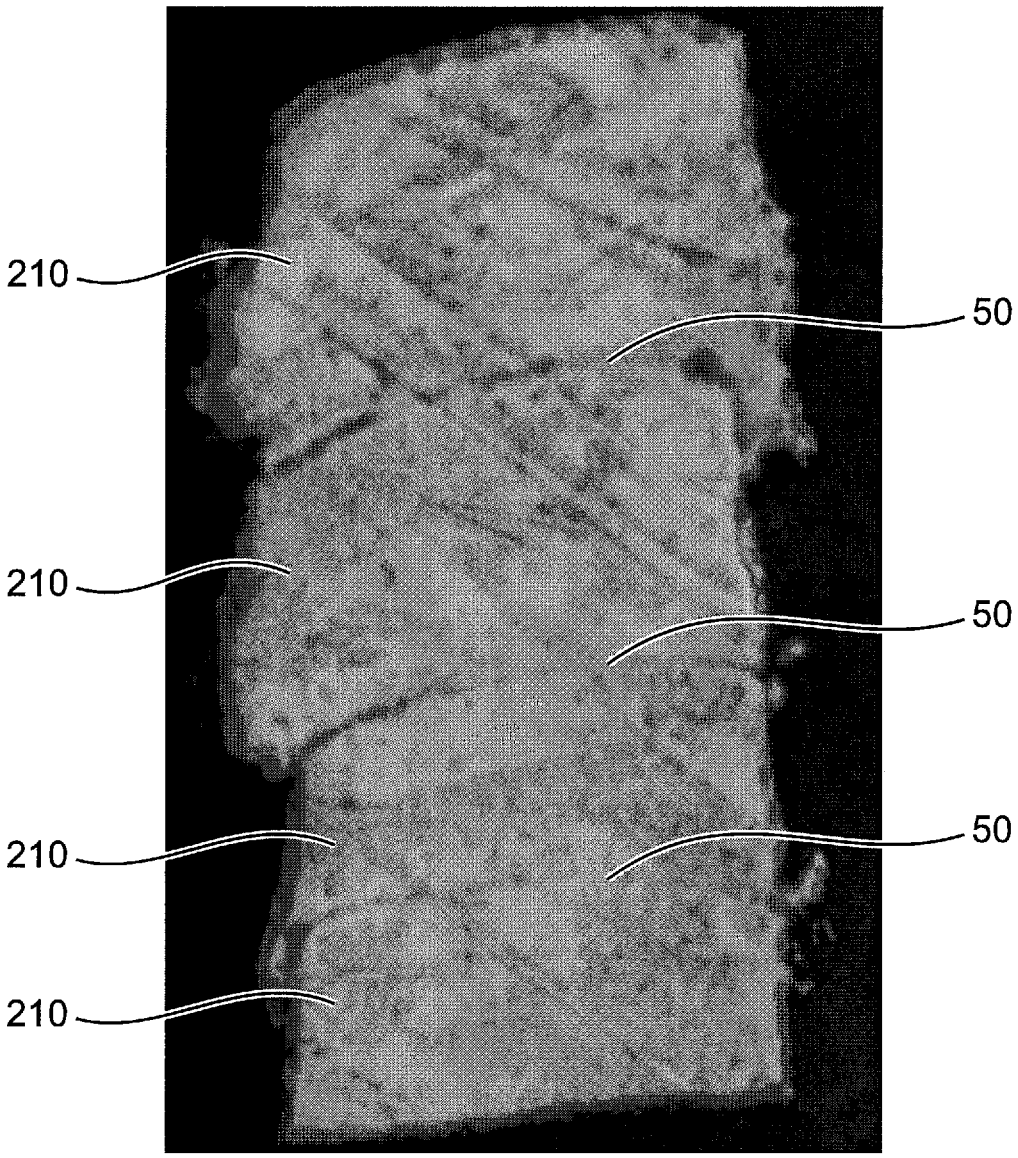
FIG. 16 is a cross-sectional picture of boundaries between the coil conductor layers.

While the intervening layers such as the seed layers are schematically shown as in FIGS. 14A to 14J and FIGS. 15A to 15F in this embodiment, a cross-sectional picture of the coil wiring in the case of having the intervening layers is shown in FIG. 16. As shown in FIG. 16, intervening layers 50 can be confirmed in an actual cross section as boundaries (black linear portions in the figure) between the coil conductor layers 210.

Fifth Embodiment

Figure 17A:
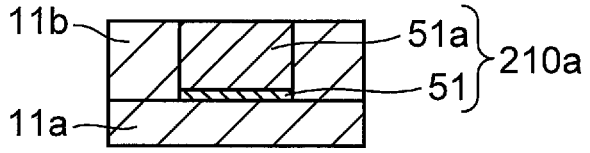
FIG. 17A is an explanatory view for explaining a method of manufacturing a coil wiring of a fifth embodiment of the inductor component.
Figure 17B:
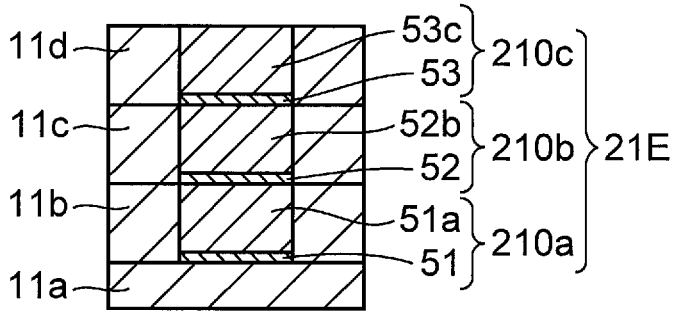
FIG. 17B is an explanatory view for explaining the manufacturing method of the coil wiring of the fifth embodiment of the inductor component.

FIGS. 17A and 17B are explanatory views of a method of manufacturing of a fifth embodiment of the inductor component of the present disclosure. The fifth embodiment is different from the fourth embodiment in the method of forming a coil wiring. This different configuration will hereinafter be described.

Although the first coil conductor layer 210*a* serving as a portion of the plurality of the coil conductor layers is formed by the semi-additive method in the coil wiring 21C of the fourth embodiment, all the coil conductor layers 210*a*, 210*b*, 210*c* are formed by the semi-additive method in a coil wiring 21E of the fifth embodiment. Therefore, as compared to the method using a conductive paste, this is advantageous for forming the high-aspect-ratio coil wiring and lowering the resistance of the coil wiring.

A method of manufacturing the coil wiring 21E will be described.

As shown in FIGS. 14A to 14C, the first seed layer 51 and the first plating growth layer 51*a* are formed on the first insulating layer 11*a* by the semi-additive method to form the first coil conductor layer 210*a* made up of the first seed layer 51 and the first plating growth layer 51*a*. As shown in FIG. 17A, the second insulating layer 11*b* is formed on the first insulating layer 11*a*.

Subsequently, as shown in FIG. 17B, the second seed layer 52 and the second plating growth layer 52*a* are formed on the second insulating layer 11*b* by the same semi-additive method as FIGS. 14A to 14C to form the second coil conductor layer 210*b* made up of the second seed layer 52 and the second plating growth layer 52*a*. The third insulating layer 11*c* is then formed on the second insulating layer lib.

Subsequently, the third seed layer 53 and the third plating growth layer 53*a* are formed on the third insulating layer 11*c* by the same semi-additive method as FIGS. 14A to 14C to form the third coil conductor layer 210*c* made up of the third seed layer 53 and the third plating growth layer 53*a*. The fourth insulating layer 11*d* is then formed on the third insulating layer 11*c*. As a result, the coil wiring 21E made up of the first coil conductor layer 210*a*, the second coil conductor layer 210*b*, and the third coil conductor layer 210*c* is formed.

Sixth Embodiment

Figure 18A:
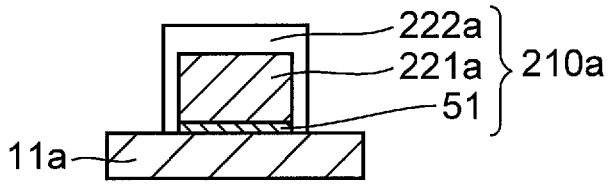
FIG. 18A is an explanatory view for explaining a method of manufacturing a coil wiring of a sixth embodiment of the inductor component.
Figure 18B:
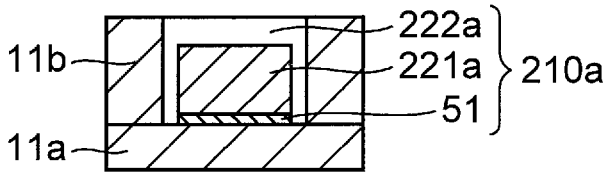
FIG. 18B is an explanatory view for explaining a method of manufacturing the coil wiring of the sixth embodiment of the inductor component.
Figure 18C:
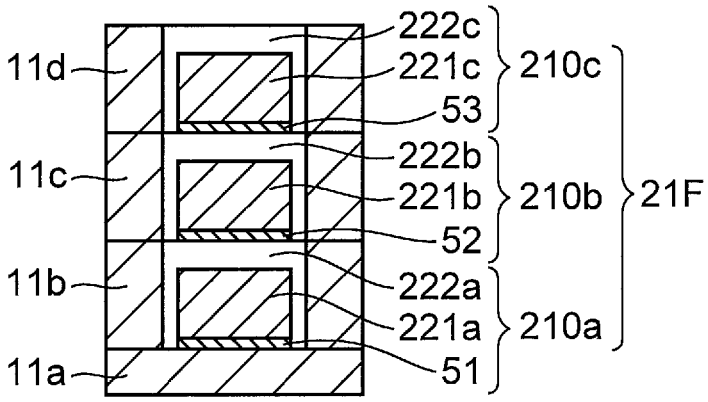
FIG. 18C is an explanatory view for explaining a method of manufacturing the coil wiring of the sixth embodiment of the inductor component.

FIGS. 18A to 18C are explanatory views of a method of manufacturing of a sixth embodiment of the inductor component of the present disclosure. The sixth embodiment is different from the fifth embodiment in the method of manufacturing a coil wiring. This different configuration will hereinafter be described.

Although all the coil conductor layers 210*a*, 210*b*, 210*c* are formed by the semi-additive method in the coil wiring 21F of the fifth embodiment, all the coil conductor layers 210*a*, 210*b*, 210*c* in the coil wiring 21F of the sixth embodiment are formed by the semi-additive method and then increased in the thickness in the coil axial direction and the wiring width by plating growth. Therefore, this is more advantageous for forming the high-aspect-ratio coil wiring and lowering the resistance of the coil wiring.

A method of manufacturing the coil wiring 21E will be described.

First, as is the case with FIGS. 14A to 14C, the first seed layer 51 and the first plating growth layer 221*a* are formed on the first insulating layer 11*a* by the semi-additive method. In this case, at the stage of FIG. 14C (after removal of the first resist 61), the plating growth of the first plating growth layer 221*a* is further achieved by the electrolytic plating through the first seed layer 51 to form a first additional plating layer 222*a*. As a result, as shown in FIG. 18A, the first coil conductor layer 210*a* made up of the first seed layer 51, the first plating growth layer 221*a*, and the first additional plating layer 222*a* is formed. As shown in FIG. 18B, the second insulating layer lib is then formed on the first insulating layer 11*a*.

Subsequently, as is the case with the first coil conductor layer 210*a*, the second seed layer 52 and the second plating growth layer 221*b* are formed on the second insulating layer 11*b* by the semi-additive method. Also in this case, the plating growth of the second plated growth layer 221*b* is further achieved to form a second additional plating layer 222*b*. As a result, the second coil conductor layer 210*b* made up of the second seed layer 52, the second plating growth layer 221*b*, and the second additional plating layer 222*b* is formed. The third insulating layer 11*c* is then formed on the second insulating layer 11*b*.

Subsequently, as is the case with the first coil conductor layer 210*a*, the third seed layer 53 and the third plating growth layer 221*c* are formed on the third insulating layer 11*c* by the semi-additive method. Also in this case, the plating growth of the third plated growth layer 221*c* is further achieved to form a third additional plating layer 222*c*. As a result, the third coil conductor layer 210*c* made up of the third seed layer 53, the third plating growth layer 221*c*, and the third additional plating layer 222*c* is formed. The fourth insulating layer 11*d* is then formed on the third insulating layer 11*c*. As a result, the coil wiring 21F made up of the first coil conductor layer 210*a*, the second coil conductor layer 210*b*, and the third coil conductor layer 210*c* shown in FIG. 18C is formed.

The present disclosure is not limited to the embodiments described above and can be changed in design without departing from the spirit of the present disclosure. For example, respective feature points of the first to sixth embodiments may variously be combined.

EXAMPLE

An example of the method of manufacturing the inductor component 1B of the third embodiment will hereinafter be described as an example.

An insulating paste mainly composed of borosilicate glass is repeatedly applied by screen printing to form an insulating layer. This insulating layer serves as an outer-layer insulating layer located on one side in the axial direction relative to the coil 20B in the element body 10.

Subsequently, the coil wiring 21B with a high aspect ratio is formed on the outer-layer insulating layer by the method described above. In this case, the electrode conductor layers 310, 410 serving as the external electrodes 30, 40 are formed at the same time.

A photolithography step is then executed to form an insulating layer provided with openings on the electrode conductor layers 310, 410 and a via hole on one end of the wiring length of the coil wiring 21B. Specifically, a photosensitive insulating paste is applied by screen printing to form a layer on the insulating layer. Ultraviolet rays etc. are then applied through a photomask to the photosensitive conductive paste layer and followed by development with an alkaline solution etc.

Subsequently, similarly, the coil wiring 21B extending from on the via hole and the electrode conductor layers 310, 410 filling the openings are formed on the insulating layer provided with the openings and the via hole. In this case, the via hole is also filled with the photosensitive conductive paste so that the via wiring 22 is formed.

Subsequently, by repeating the steps, the insulating layer, the coil wiring 21B, and the electrode conductor layers 310, 410 are sequentially formed. Additionally, an insulating paste is repeatedly applied by screen printing to form an insulating layer. This insulating layer serves as an outer-layer insulating layer located on the other side in the axial direction relative to the coil 20B in the element body 10. Through the steps described above, a mother laminated body is acquired. In this case, the mother laminated body has a plurality of portions serving as the inductor components 1B formed in a matrix shape.

Subsequently, the mother laminated body is cut into a plurality of unfired laminated bodies by dicing etc. In the step of cutting the mother laminated body, the electrode conductor layers 310, 410 are exposed from the laminated bodies on cut surfaces formed by cutting.

The unfired laminated bodies are fired under predetermined conditions to acquire laminated bodies. These laminated bodies are subjected to barrel finishing. Portions of the electrode conductor layers 310, 410 exposed from the laminated bodies are subjected to Ni plating having a thickness of 2 μm to 10 μm, for example, and Sn plating having a thickness of 2 μm to 10 μm, for example. Through the steps described above, for example, inductor components of 0.4 mm×0.2 mm×0.2 mm are completed.

The construction method of forming the coil conductor layers is not limited to the above method and may be a method using etching for forming a pattern of a conductor film formed by a vapor deposition method, pressure bonding of a foil, etc., or may be a method such as plating transfer.

The conductor material of the coil and the external electrodes may be a good conductor such as Ag, Cu, and Au.

The method of forming the insulating layers as well as the openings and the via holes is not limited to the above method and may be a method in which after pressure bonding, spin coating, or spray application of an insulating material sheet, the sheet is opened by laser or drilling.

The size of the inductor component is not limited to the above description. The method of forming the external electrodes is not limited to the method of applying plating to the electrode conductor layers embedded in the element body and exposed by cutting, and may be a method including further forming conductor layers by dipping of a conductor paste, a sputtering method, etc. on the electrode conductor layers or lead-out wirings exposed by cutting, and then applying plating thereto.

Although the shape of the coil is a helical shape in the embodiments described above, the shape may be a spiral shape.

The invention claimed is:

1. An inductor component comprising:

an element body including two end surfaces opposite to each other and a bottom surface connected between the two end surfaces;

a coil provided in the element body and wound helically; and two external electrodes provided in/on the element body and electrically connected to the coil, wherein one of the external electrodes is formed over one of the end surfaces and the bottom surface while the other external electrode is formed over the other of the end surfaces and the bottom surface, wherein the coil is formed such that an axial direction thereof is along the two end surfaces, wherein the coil includes a coil wiring wound along a plane orthogonal to the axial direction, and wherein an aspect ratio of the coil wiring is 1.0 or more and less than 8.0.

2. The inductor component according to claim 1, wherein the aspect ratio of the coil wiring is 1.5 or more and less than 6.0.

3. The inductor component according to claim 1, wherein the coil wiring is made up of a plurality of coil conductor layers laminated in surface contact with each other.

4. The inductor component according to claim 3, wherein the multiple coil conductor layers constituting the coil wiring are equal to each other in wiring length and are in surface contact with each other over the wiring length.

5. The inductor component according to claim 1, wherein the wiring width of the coil wiring is 60 μm or less.

6. The inductor component according to claim 1, wherein the coil wiring varies in wiring width along the axial direction, wherein the coil wiring has an inner surface partially projecting to the inside of the coil wiring, and wherein a ratio (e/c) of a projection amount e of the inner surface to a maximum wiring width c of the coil wiring is 20% or less.

7. The inductor component according to claim 6, wherein the ratio (e/c) is 5% or less.

8. The inductor component according to claim 1, wherein the coil wiring varies in wiring width along the axial direction, and wherein a ratio (a/c) of a difference (a) between a maximum wiring width (c) and a minimum wiring width of the coil wiring to the maximum width (c) is 40% or less.

9. The inductor component according to claim 3, wherein the aspect ratio of the coil conductor layer is 2.0 or less.

10. The inductor component according to claim 3, wherein no intervening layer exists between the coil conductor layers in surface contact and between the coil conductor layers and the element body.

11. The inductor component according to claim 3, wherein an intervening layer exists in at least a portion between the coil conductor layers in surface contact and between the coil conductor layers and the element body.

12. The inductor component according to claim 10, wherein a transverse cross section of the coil wiring has a T shape, an I shape, or a stacked shape of T.

13. The inductor component according to claim 3, wherein the plurality of coil conductor layers constituting the coil wiring includes a first coil conductor layer and a second coil conductor layer having the same width in a coil radial direction, and wherein a ratio (d/c) of a deviation amount d between the center of the wiring width of the first coil conductor layer and the center of the wiring width of the second coil conductor layer to the wiring width c of the first coil conductor layer and the second coil conductor layer is 20% or less.

14. The inductor component according to claim 1, wherein the length of the coil in the axial direction is equal to or greater than 50% of the width of the element body in the axial direction.

15. A method of manufacturing the inductor component according to claim 11, wherein a portion of the plurality of coil conductor layers is formed by a semi-additive method.

16. A method of manufacturing the inductor component according to claim 11, wherein the plurality of coil conductor layers is all formed by a semi-additive method.

17. A method of manufacturing the inductor component according to claim 11, wherein a portion of the plurality of coil conductor layers is formed by plating growth.

18. The method of manufacturing the inductor component according to claim 15, wherein a portion of the plurality of coil conductor layers is further formed by plating growth.

19. The method of manufacturing the inductor component according to claim 16, wherein the plurality of coil conductor layers is all further formed by plating growth.

20. A method of manufacturing the inductor component according to claim 10, comprising the steps of:

forming a first groove in a first insulating layer constituting the element body;

applying a photosensitive conductive paste into the first groove to form a first coil conductor layer in the first groove by a photolithographic method;

forming a second insulating layer constituting the element body on the first insulating layer and forming a second groove in the second insulating layer; and applying a photosensitive conductive paste into the second groove to form a second coil conductor layer coming into surface contact with the first coil conductor layer in the second groove by a photolithographic method.

* * * * *